US010916904B2

(12) United States Patent
Reese et al.

(10) Patent No.: US 10,916,904 B2
(45) Date of Patent: Feb. 9, 2021

(54) POWER CONNECTION ASSEMBLY

(71) Applicant: WHIRLPOOL CORPORATION, Benton Harbor, MI (US)

(72) Inventors: Robin A. Reese, La Porte, IN (US); Erich A. Kirchner, Stevensville, MI (US); Kristian N. Engelsen, South Bend, IN (US); Janglih J. Lin, Normal, IL (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/546,841

(22) Filed: Aug. 21, 2019

(65) Prior Publication Data

US 2020/0076143 A1 Mar. 5, 2020

Related U.S. Application Data

(60) Provisional application No. 62/724,787, filed on Aug. 30, 2018.

(51) Int. Cl.

| | |
|---|---|
| ***H01R 31/06*** | (2006.01) |
| ***H01R 25/00*** | (2006.01) |
| ***H01R 13/639*** | (2006.01) |

(52) U.S. Cl.

CPC ..... *H01R 31/06* (2013.01); *H01R 13/639* (2013.01); *H01R 25/006* (2013.01)

(58) Field of Classification Search

CPC .... H01R 13/622; H01R 31/06; H01R 13/625; H01R 13/635; H01R 13/701

USPC ..... 439/304

See application file for complete search history.

(56) References Cited

U.S. PATENT DOCUMENTS

| | | | |
|---|---|---|---|
| 3,984,168 | A | 10/1976 | Korman |
| 4,445,469 | A | 5/1984 | Suhayda |
| 4,445,743 | A | 5/1984 | Bakker |
| 4,457,572 | A | 7/1984 | Frazier et al. |
| 4,462,652 | A | 7/1984 | Werth et al. |
| 4,531,800 | A | 7/1985 | Avener |
| 4,772,215 | A | 9/1988 | Falk |
| 5,181,860 | A | 1/1993 | Honma et al. |
| 5,205,749 | A | 4/1993 | Weingartner |
| 5,220,268 | A | 6/1993 | Rose et al. |
| 5,344,333 | A | 9/1994 | Haag |

(Continued)

FOREIGN PATENT DOCUMENTS

| | | | |
|---|---|---|---|
| CN | 101640353 | A | 2/2010 |
| CN | 107959177 | A | 4/2018 |

(Continued)

*Primary Examiner* — Jean F Duverne

(74) *Attorney, Agent, or Firm* — Price Heneveld LLP

(57) ABSTRACT

A power connection assembly for an appliance includes a receptacle that has an inner wall. The inner wall defines a cavity. A channel is defined by the inner wall and is in communication with the cavity. A power cord is configured to be at least partially received by the cavity of the receptacle. A cap is rotatable between a locked position and an unlocked position and is configured to at least partially encase the power cord. A protrusion extends radially from the cap. A switch is positioned proximate the channel and is operable between an open position and a closed position. The protrusion is received by the channel and is configured to move the switch to the closed position.

20 Claims, 28 Drawing Sheets

(56) References Cited

U.S. PATENT DOCUMENTS

| | | | | |
|---|---|---|---|---|
| 5,590,228 | A | 12/1996 | Gibola et al. | |
| 5,921,794 | A | 7/1999 | Koch | |
| 5,928,021 | A | 7/1999 | Koch | |
| 6,203,349 | B1 | 3/2001 | Nakazawa | |
| 6,554,629 | B2 * | 4/2003 | Koch | H01R 13/622 200/51.09 |
| 7,431,601 | B2 | 10/2008 | Nugent, Jr. et al. | |
| 10,446,990 | B2 * | 10/2019 | Dykas | H01R 13/7038 |
| 2010/0136808 | A1 | 6/2010 | Vanzo | |
| 2015/0049573 | A1 | 2/2015 | Calange | |

FOREIGN PATENT DOCUMENTS

| | | | |
|---|---|---|---|
| DE | 945577 | C | 7/1956 |
| WO | 2017198338 | A1 | 11/2017 |

* cited by examiner

POWER CONNECTION ASSEMBLY

CROSS-REFERENCE TO RELATED APPLICATIONS

This patent application claims priority under 35 U.S.C. § 119(e) to U.S. Provisional Patent Application No. 62/724,787, entitled "POWER CONNECTION ASSEMBLY," and filed Aug. 30, 2018, the entire disclosure of which is incorporated herein by reference.

FIELD OF DISCLOSURE

The present device generally relates to a power connection assembly, and more specifically, to a power connection assembly for an appliance.

BACKGROUND

Appliance power connections requiring installation of individual wires of a power supply cord onto a terminal block can be difficult for some consumers. A power connection assembly that is easy to install and use is described herein.

SUMMARY

In at least one aspect, a power connection assembly for an appliance includes a receptacle that has an inner wall. The inner wall defines a cavity. A channel is defined by the inner wall and is in communication with the cavity. A power cord is configured to be at least partially received by the cavity of the receptacle. A cap is rotatable between a locked position and an unlocked position and is configured to at least partially encase the power cord. A protrusion extends radially from the cap. A switch is positioned proximate the channel and is operable between an open position and a closed position. The protrusion is received by the channel and is configured to move the switch to the closed position.

In another aspect, a power connection assembly for an appliance includes a receptacle that is coupled with a mounting plate. A power cord is configured to be received by the receptacle. A cap is coupled with the power cord and is configured to be at least partially received by the receptacle. A protrusion extends from the cap and defines a first slot. A ring is rotatably coupled with the receptacle. A second slot is defined by an inner wall of the receptacle and the ring. A spring is received by the second slot and is configured to bias the ring in a neutral position.

In yet another aspect, a power connection assembly includes a housing that is positioned over a power cord. The housing surrounds a locking assembly. The locking assembly is operable between an unlocked and a locked position. A protrusion extends from the housing and is rotatable between a first position and a second position. The first and second positions correspond with the unlocked and locked positions of the locking assembly, respectively. A spring is configured to bias the protrusion in the first position. A switch is configured to be actuated when the locking assembly is in the locked position.

In at least another aspect, a power connection assembly for an appliance includes a cap operably coupled with a power cord. The cap is rotatable between a locked position and an unlocked position and is configured to at least partially encase the power cord. A receptacle is configured to at least partially receive the power cord. A protrusion extends from the cap. A spring is configured to bias the cap into the unlocked position. A switch is operable between an open position and a closed position, wherein the switch is in the closed position when the cap is in the locked position.

These and other features, advantages, and objects of the present device will be further understood and appreciated by those skilled in the art upon studying the following specification, claims, and appended drawings.

DETAILED DESCRIPTION OF THE EMBODIMENTS

Figure 2:
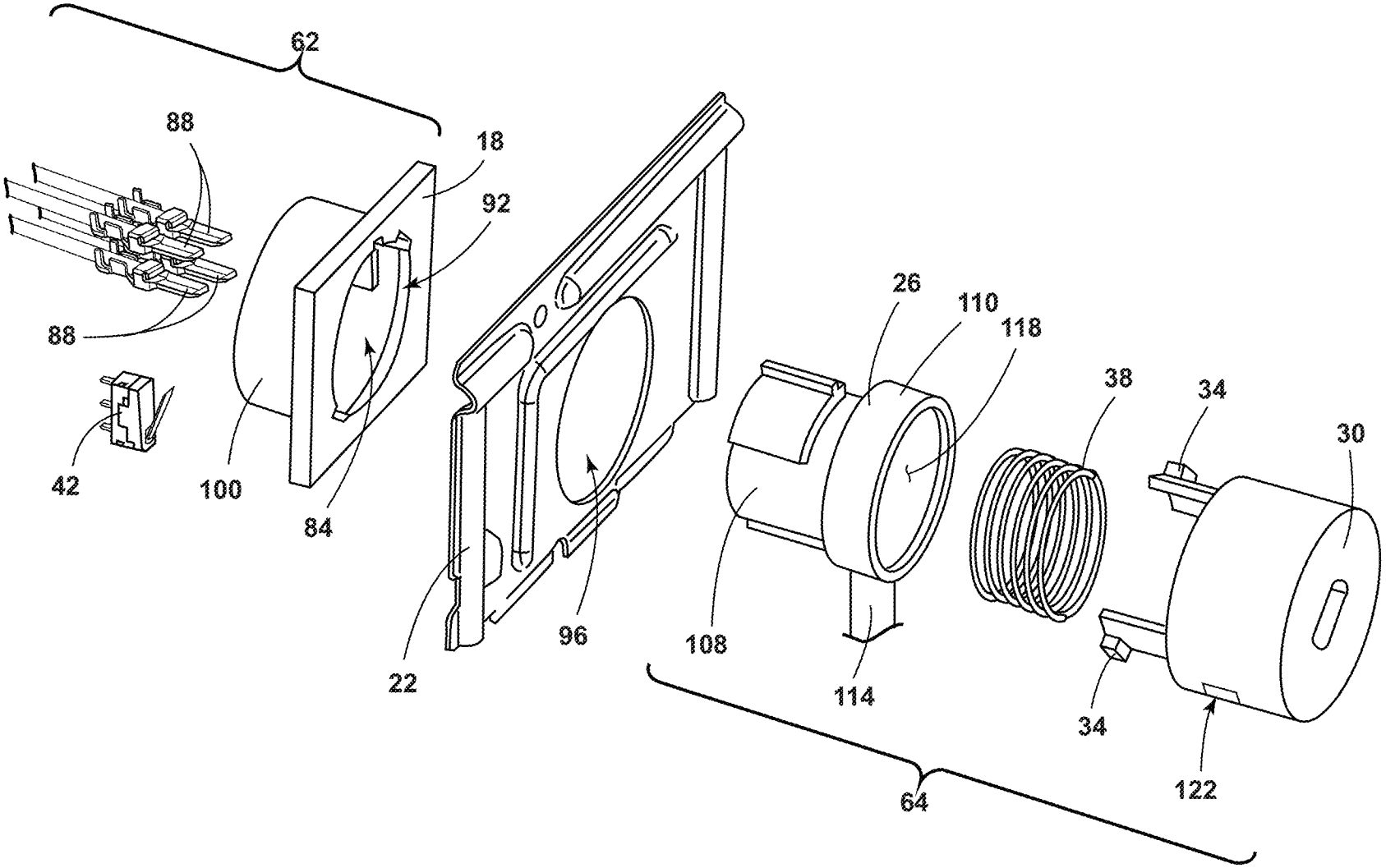
FIG. 2 is an exploded top perspective view of the power connection assembly of FIG. 1.

For purposes of description herein the terms "upper," "lower," "right," "left," "rear," "front," "vertical," "horizontal," and derivatives thereof shall relate to the device as oriented in FIG. 2. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

Referring to FIGS. 1-26, reference number 10 generally refers to a power connection assembly for an appliance 14 that includes a receptacle 18 positioned on a mounting plate 22, a power cord 26 received by the receptacle 18, and a cap 30 positioned over the power cord 26. The cap 30 is operable between a locked position and an unlocked position. The power connection assembly 10 further includes a protrusion 34 that extends from the cap 30 and is received by the receptacle 18, a spring 38 that is configured to bias the cap 30 in the unlocked position, and a switch 42 positioned proximate the receptacle 18 and configured to be actuated when the cap 30 is in the locked position.

Figure 1:
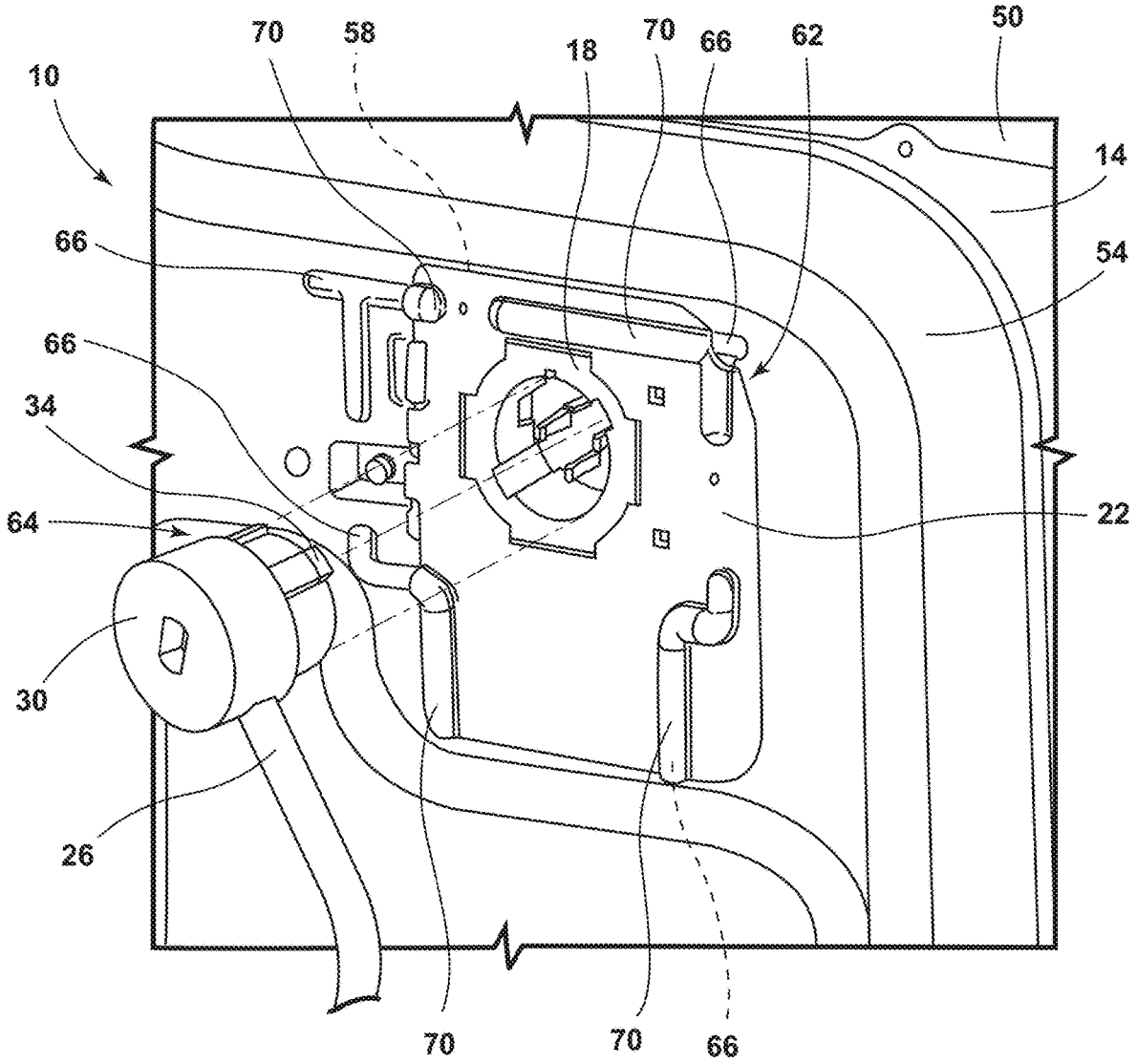
FIG. 1 is a partial side perspective view of a rear wall of an appliance having a power connection assembly, according to some examples.

Referring now to FIG. 1, the appliance 14 is illustrated including the power connection assembly 10, according to various examples, and an appliance body 50. The power connection assembly 10 includes a receptacle assembly 62 and a power cord assembly 64. The appliance body 50 has a rear wall 54 disposed to cover interior components of the appliance 14, including, for example, electrical and/or heating elements. The power connection assembly 10 may be at least partially positioned on and/or coupled with the rear wall 54 and may be configured to provide power to the appliance 14. It is contemplated that the power connection assembly 10 may be coupled to any other wall of the appliance body 50 in the same manner as described below. It is further contemplated that the appliance 14 may be any appliance 14 requiring a power connection assembly 10, including, for example, a washer, a dryer, an oven, a range, a freezer, and/or a commercial variation of any of these.

The rear wall 54 of the appliance body 50 defines an opening 58 configured to receive the receptacle assembly 62 of the power connection assembly 10. The opening 58 may be any shape or size configured to receive the receptacle assembly 62. When the power connection assembly 10 is coupled with the rear wall 54 of the appliance body 50, the opening 58 is at least partially covered by the mounting plate 22 of the receptacle assembly 62. For example, the mounting plate 22 may be sized to extend beyond a perimeter of the opening 58, or may extend to the perimeter of the opening 58. Further, the mounting plate 22 may be any shape configured to be positioned over the opening 58, such as generally rectangular, as illustrated in FIG. 1.

In various examples, a plurality of guide features 66 may be disposed on the rear wall 54 of the appliance 14 proximate the opening 58. For example, the plurality of guide features 66 may be spaced about the periphery of the opening 58, or may be positioned to frame the opening 58. The plurality of guide features 66 may be configured to extend from the rear wall 54. The mounting plate 22 may define a plurality of guide channels 70 positioned to complement the plurality of guide features 66. Each of the plurality of guide channels 70 is configured to at least partially receive a respective guide feature 66 of the plurality of guide features 66. The alignment of the plurality of guide features 66 with the plurality of guide channels 70 is configured to align the mounting plate 22 to cover the opening 58.

The power cord assembly 64 of the power connection assembly 10 is configured to be at least partially received by the receptacle assembly 62 and to provide power to the appliance 14 by electrically engaging the receptacle assembly 62. It will be understood that the power cord 26 of the power cord assembly 64 may be for use with any voltage, including, for example, 110 volts, 120 volts, 220 volts, or 240 volts. In other words, the power cord 26 operates at a voltage of one of 110 volts, 120 volts, 220 volts, and 240 volts.

Referring now to FIG. 2, the receptacle assembly 62 includes at least the mounting plate 22 and the receptacle 18. When the mounting plate 22 is coupled with the rear wall 54 of the appliance 14, the receptacle 18 may be coupled with and/or supported by the mounting plate 22. For example, the mounting plate 22 may define a first opening 96 configured to receive and/or align with the receptacle 18. Further, the receptacle 18 defines a cavity 84 and a second opening 92 in communication with the cavity 84. When the receptacle 18 is received or aligned with the first opening 96, the second opening 92 is also aligned with the first opening 96. In various examples, the first opening 96 may be sized to complement the second opening 92. In other examples, the first opening 96 may be larger than the second opening 92, such that a front face of the receptacle 18 is exposed by the first opening 96.

Referring to FIGS. 1 and 2, the receptacle assembly 62 is configured to mate with the power cord assembly 64 to provide power to the appliance 14. For example, at least the power cord 26 of the power cord assembly 64 is configured to be at least partially received by at least the cavity 84 and the second opening 92 of the receptacle 18. The power cord 26 extends through the first opening 96 of the mounting plate 22 and the second opening 92 of the receptacle 18 and is received by the cavity 84 of the receptacle 18. In other words, the mounting plate 22 defines the first opening 96 configured to receive the power cord 26. The power cord 26 of the power cord assembly 64 provides power to the appliance 14 by electrically engaging the receptacle 18 of the receptacle assembly 62, as discussed herein.

The power cord 26 includes a first portion 108 and a second portion 110. The first portion 108 extends from the second portion 110 and is configured to be received by the receptacle 18. The second portion 110 includes a cord 114 and an outer face 118. The cap 30 is configured to be positioned over the power cord 26. For example, the cap 30 may be fitted over the outer face 118 of the second portion 110. In various examples, the cap 30 may be fixedly coupled with or integrally formed with the power cord 26 to form a permanent housing. In other examples, the cap 30 may be removably coupled with the power cord 26. The cap 30 is also at least partially received by the receptacle 18.

Figure 3:
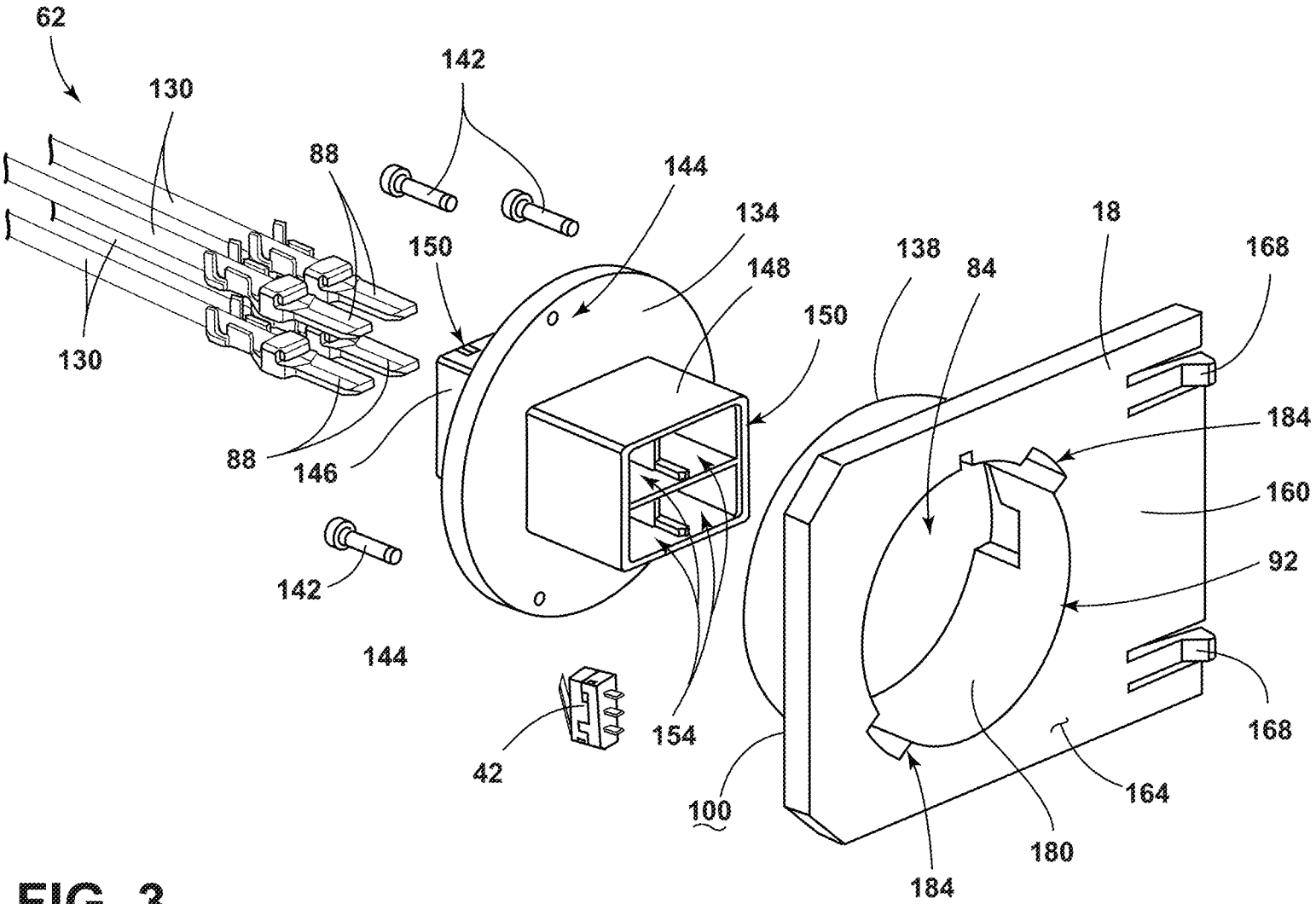
FIG. 3 is an exploded top perspective view of a receptacle assembly of the power connection assembly of FIG. 1.

Referring now to FIGS. 2 and 3, the receptacle assembly 62 is illustrated in detail, according to various examples. The receptacle 18 of the receptacle assembly 62 includes an inner wall 180 that defines the cavity 84 in communication with the second opening 92. The cavity 84 and the second opening 92 generally have a circular cross-section. However, it is contemplated that the cavity 84 and the second opening 92 may have various corresponding shapes, including, for example, an elliptical prism and an ellipse, a cube and a square, a rectangular prism and a rectangle, and/or any combination thereof. The inner wall 180 further defines a channel 184 in communication with the cavity 84 and configured to receive the protrusions 34 of the cap 30.

The receptacle assembly 62 includes a plurality of prongs 88 positioned to extend from a back panel 134 of the receptacle 18 and into the cavity 84. The plurality of prongs 88 extend toward the second opening 92 of the receptacle 18 and are engageable with the power cord 26. For example, each of the plurality of prongs 88 may be configured to be at least partially received by the first portion 108 of the power cord 26 when the first portion 108 is received by the receptacle 18. Each of the plurality of prongs 88 is operably coupled with electrical wiring 130 and may be configured as a male electrical connector.

According to various examples, the receptacle 18 includes the back panel 134 configured to be secured to a back rim 138 of the receptacle 18 by a plurality of fasteners 142. The fasteners 142 extend through a plurality of apertures 144 defined by the back panel 134 to removably couple the back panel 134 to the back rim 138 of the receptacle 18. It is contemplated that other methods of coupling the back panel 134 may be used such as, for example, press lock connections between the back panel 134 and the receptacle 18. It is also contemplated that the back panel 134 may be fixedly coupled to the receptacle 18, for example, using welding or an adhesive.

Referring still to FIGS. 2 and 3, the back panel 134 may also include a first extension 146 and a second extension 148. Both the first and second extensions 146, 148 may be generally cubical and extend from opposite sides of the back panel 134. The first and second extensions 146, 148 are aligned to define a channel 150 that extends through the first and second extensions 146, 148 and the back panel 134. The channel 150 may be subdivided into a plurality of receiving channels 154. For example, the channel 150 may be subdivided into a plurality of receiving channels 154 arranged in a 2×2 configuration, as illustrated in FIG. 3. Alternatively, any other arrangement of receiving channels 154 may be used, including, for example, any one of 1×2, 2×1, 2×3, 3×1, 3×2, and 3×3 configurations, and so on. Further, the receiving channels 154 may be positioned in an asymmetrical arrangement or may be spaced circumferentially about the back panel 134. Each of the plurality of receiving channels 154 may be configured to act as a guide for a respective prong 88 of the plurality of prongs 88. In other words, each of the plurality of prongs 88 is configured to be positioned within a respective receiving channel 154. In some examples (FIG. 2), it is contemplated that the plurality of prongs 88 may be received directly by the cavity 84 of the receptacle 18 without the use of the removable back panel 134.

Figure 10:
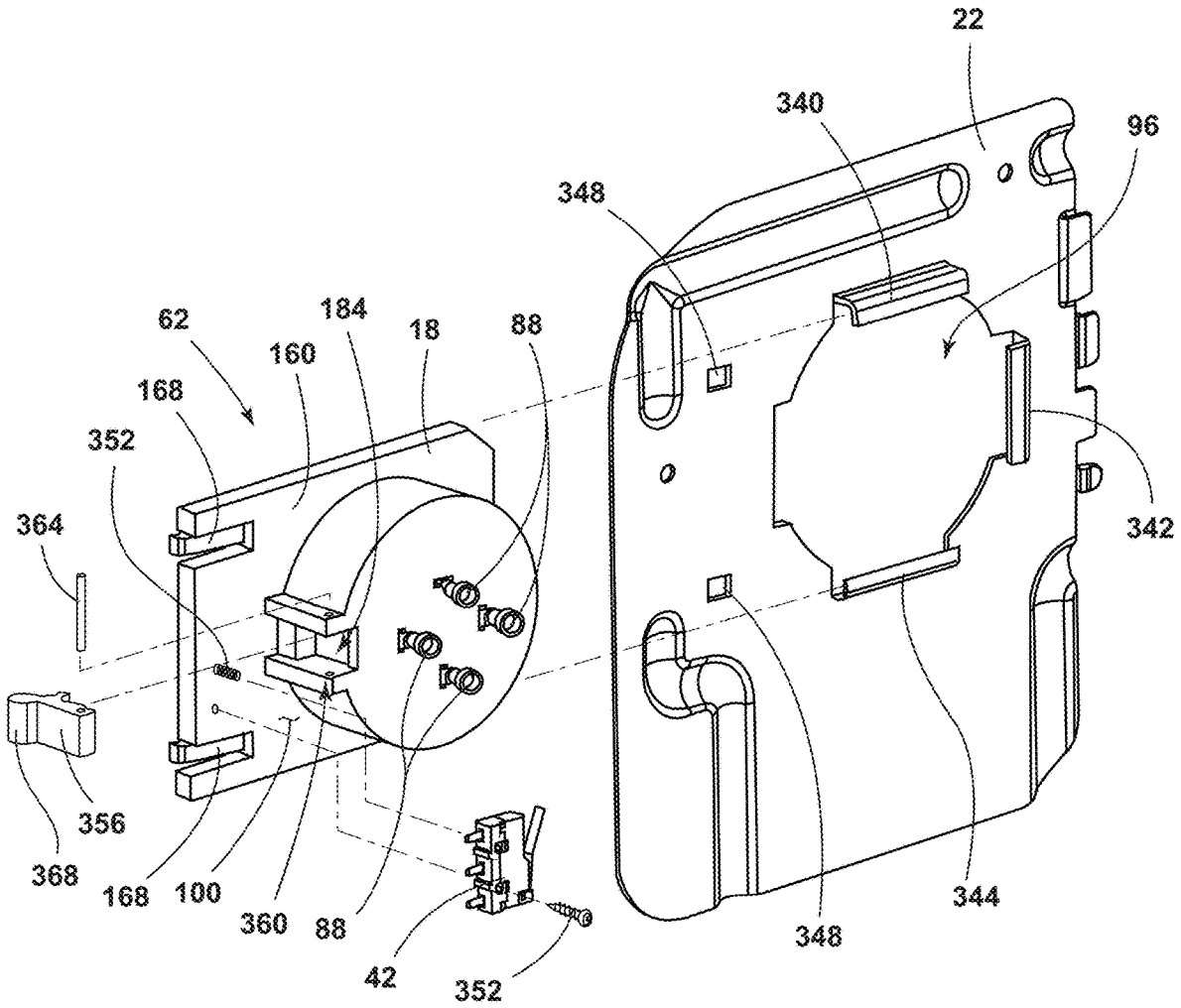
FIG. 10 is an exploded rear perspective view of a receptacle assembly and a mounting plate of a power connection assembly with the power connection assembly having a switch, according to some examples.
Figure 11:
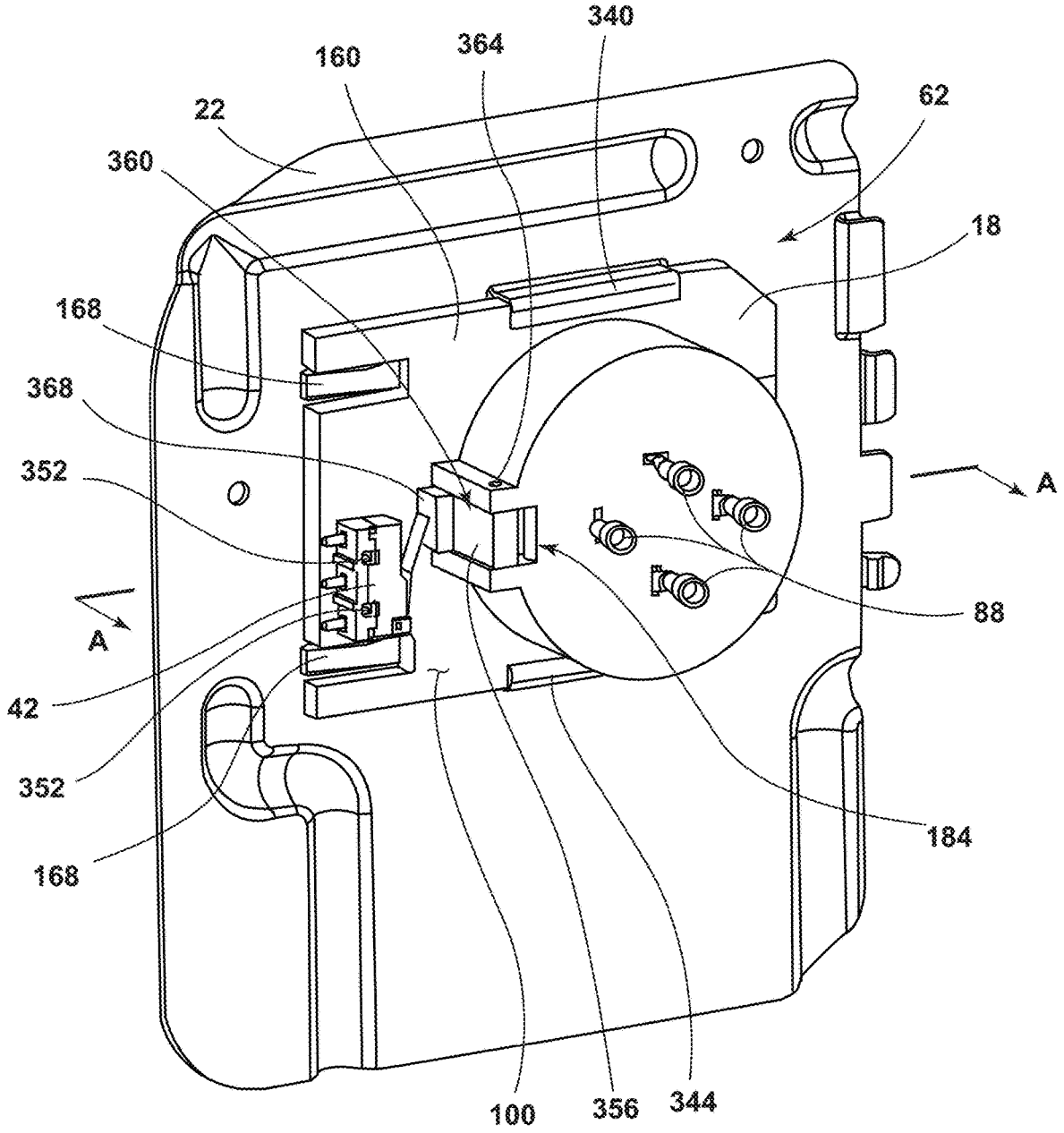
FIG. 11 is a rear perspective view of the receptacle assembly and switch of FIG. 10, shown assembled.

The receptacle 18 may further include an edge plate 160 extending about the cavity 84. The edge plate 160 includes a front surface 164 and the rear surface 100. When the receptacle 18 is coupled with the mounting plate 22, the front surface 164 abuts the mounting plate 22 and may be visible through the first opening 96 of the mounting plate 22. The edge plate 160 may further include clips 168 for coupling the edge plate 160 of the receptacle 18 with the receptacle assembly 62 to the mounting plate 22 (FIGS. 10 and 11).

The receptacle assembly 62 also includes the switch 42. In various examples, the switch 42 is positioned on the rear surface 100 of the edge plate 160 of the receptacle 18. In other examples, the switch 42 may be integrally formed with the receptacle 18. For example, the switch 42 may be integrally formed with the back panel 134 of the receptacle 18. The switch 42 is configured to be selectively operable between an open position and a closed position. When the switch 42 is in the closed position, a circuit of the power connection assembly 10 is closed to provide power to the appliance 14. When the switch 42 is in the open position, the circuit of the power connection assembly 10 is open and power is not provided to the appliance 14. The switch 42 may be electrically coupled with the plurality of prongs 88. The switch 42 may be moved between the open and closed positions by engagement or disengagement of the power cord assembly 64 and the receptacle assembly 62, as discussed in more detail herein.

Figure 4A:
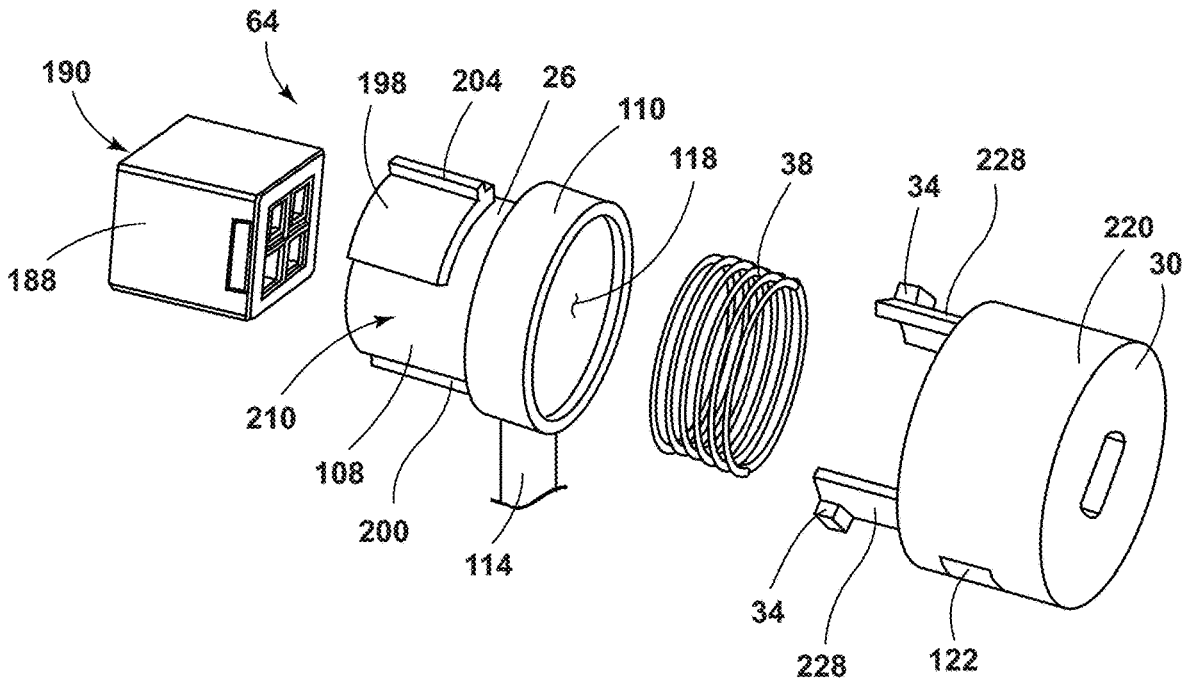
FIG. 4A is an exploded top perspective view of a power cord assembly of the power connection assembly of FIG. 1.
Figure 4B:
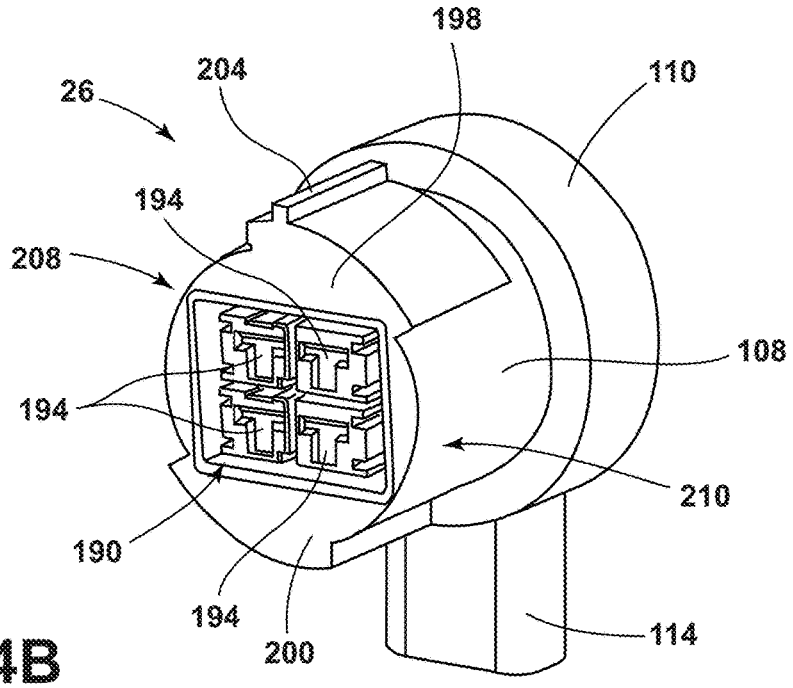
FIG. 4B is a rear perspective view of the power cord assembly of FIG. 4A.

Referring now to FIGS. 2, 4A, and 4B, the power cord assembly 64 is shown in detail, according to some examples. The power cord assembly 64 includes the power cord 26 that has the first portion 108 and the second portion 110. As illustrated in FIG. 4A, the first portion 108 includes a housing 188. For example, the first portion 108 may be configured to receive the housing 188, or the housing 188 may be integrally formed with the first portion 108 of the power cord 26. The housing 188 defines a receiving well 190 shaped to complement and receive the second extension 148 of the receptacle 18 when the power cord 26 is received by the receptacle 18. The first portion 108 is configured to receive the plurality of prongs 88. The receiving well 190 may include a plurality of receiving members 194 positioned in the same configuration as the plurality of prongs 88 and/or the plurality of receiving channels 154 of the receptacle assembly 62. In various examples, the plurality of receiving members 194 may be configured as female electrical connectors positioned to receive the plurality of prongs 88. In other examples, electrical connectors may be positioned within each of the plurality of receiving members 194. Alternatively, the plurality of receiving members 194 may be defined by the housing 188, or the plurality of receiving members 194 may be members that extend through the first portion 108 of the power cord 26. It is contemplated that the plurality of receiving members 194 may be positioned within the first portion 108 of the power cord 26 without the housing 188.

Referring now to FIGS. 4A and 4B, the power cord 26 includes opposing first and second guide protrusions 198, 200 that extend laterally from the first portion 108. Each of the first and second guide protrusions 198, 200 are generally wedge-shaped when viewed from the rear of the power cord 26, and each of the first and second guide protrusions 198, 200 extend circumferentially about the first portion 108 of the power cord 26. The first and second guide protrusions 198, 200 are positioned to define first and second spaces 208, 210 and parameters of rotation for the protrusions 34 of the cap 30. In various examples, the first guide protrusion 198 includes a tab 204 that is positioned vertically. The first and second guide protrusions 198, 200 and the tab 204 may be configured to guide proper placement of the power cord 26 within the receptacle 18 to ensure a correct fit for an electrical connection.

The second portion 110 of the power cord 26 includes the outer face 118 configured to be covered by the cap 30. In various examples, the cap 30 may include a body portion 220 that defines an elongated cord opening 122. The cord opening 122 is configured to receive the cord 114 of the power cord 26 when the cap 30 is positioned over the power cord 26. The cord opening 122 is further configured to allow for rotation of the cap 30 when the cord 114 is received by the cord opening 122. The cord opening 122 may be sized to accommodate various types of cords 114 or may be configured to be used with only one type of cord 114.

Figure 9A:
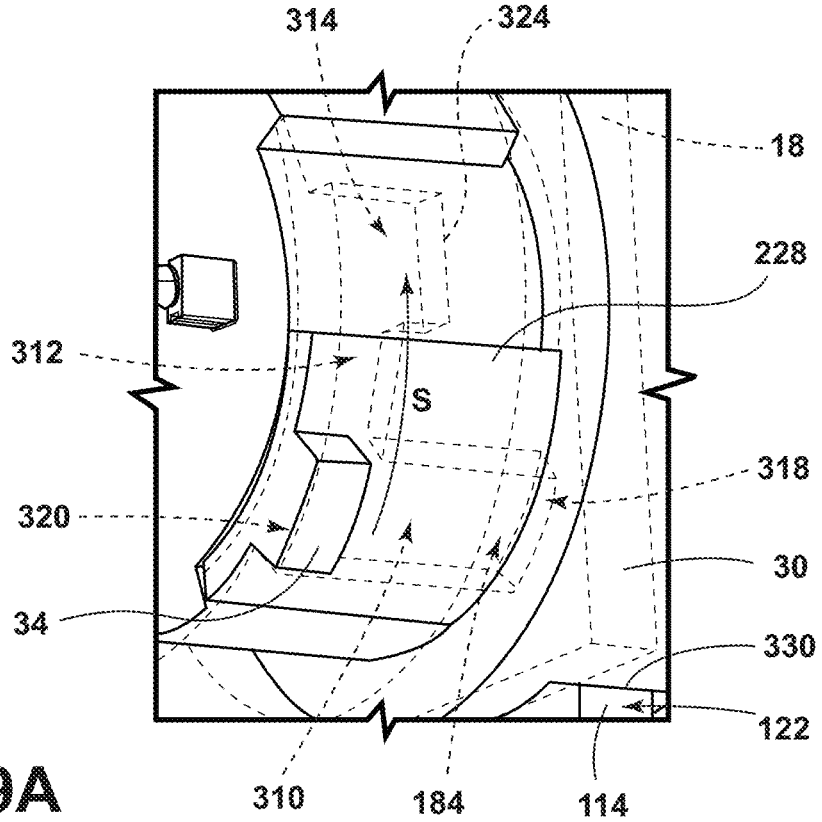
FIG. 9A is a partial side perspective view of the power cord assembly and the cap of FIG. 4A, after engagement with the receptacle assembly of FIG. 3, and shown with the receptacle assembly in phantom and the cap in a first position.
Figure 9B:
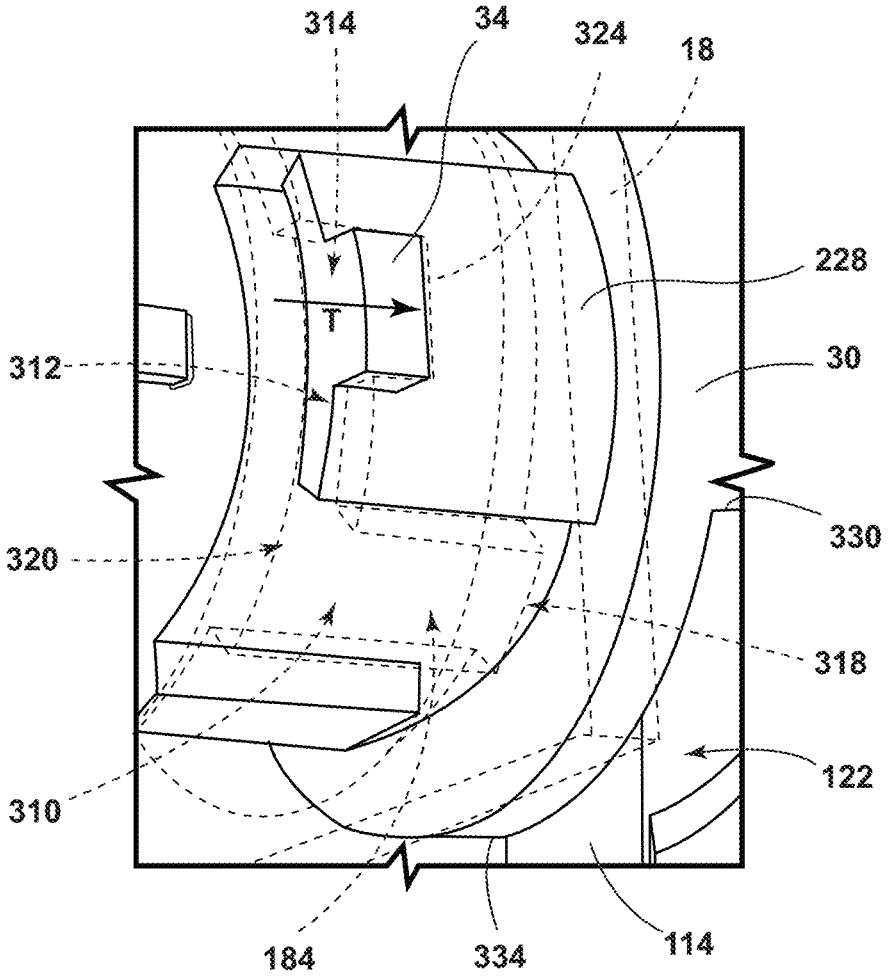
FIG. 9B is a partial side perspective view of the power cord assembly and the cap of FIG. 4A, after engagement with the receptacle assembly of FIG. 3, and shown with the receptacle assembly in phantom and the cap in a second position.

The cap 30 includes extensions 228 that extend from a bottom surface of the body portion 220 of the cap 30. The extensions 228 are curved to follow the circumference of the cap 30 and are circumferentially spaced apart. As illustrated in FIG. 4A, the cap 30 includes two extensions 228. However, it is contemplated that the cap 30 may include a plurality of extensions 228 circumferentially spaced about the cap 30. Each of the extensions 228 is configured to be received by one of the first and second spaces 208, 210 and the receptacle 18 when the power connection assembly 10 is assembled (FIGS. 9A and 9B). Further, each extension 228 includes a respective protrusion 34 that extends perpendicular to the extension 228 and outward of the cap 30. Each protrusion 34 may be configured to be received by one of the channels 184 when the power cord 26 and the cap 30 are received by the receptacle 18 (FIGS. 9A and 9B).

As illustrated in FIG. 4A, the spring 38 is configured to be positioned flush with the outer face 118 and is received by a cavity 218 defined by the cap 30. The spring 38 is configured to bias the cap 30 into an unlocked position when the cap 30 is initially received by the receptacle 18 and into a locked position when the cap 30 is rotated within the receptacle 18. In other words, the spring 38 is configured to bias the cap 30 away from the outer face 118 and/or the corresponding receptacle 18.

Figure 5:
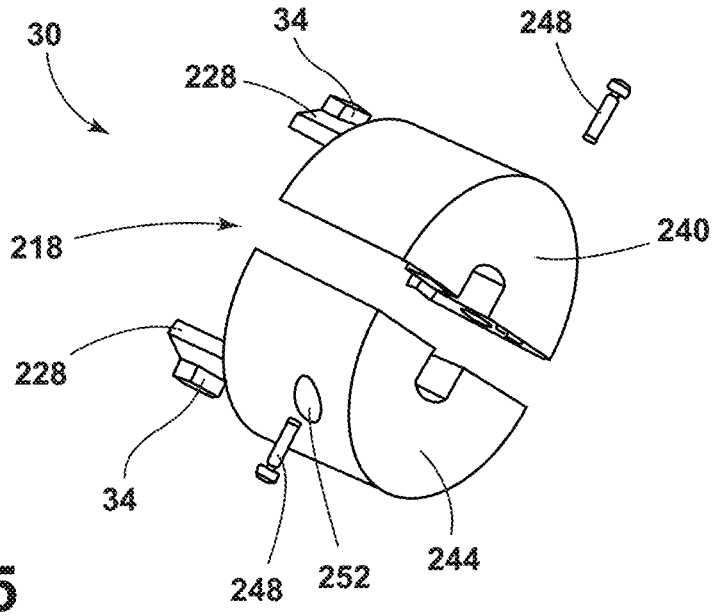
FIG. 5 is an exploded side perspective view of a cap of a power cord assembly, according to some examples.

Referring now to FIG. 5, according to some examples, the cap 30 may include a first side portion 240 and a second side portion 244. The first and second side portions 240, 244 are configured to allow positioning of the cap 30 over the power cord 26, as illustrated in FIG. 2. Each of the first side portion 240 and the second side portion 244 is generally semi-cylindrical and includes one of the extensions 228 and the respective protrusion 34. Together, the first side portion 240 and the second side portion 244 define the cavity 218 configured to receive the power cord 26. Each of the first side portion 240 and the second side portion 244 is configured to fit over a respective half of the second portion 110 of the power cord 26 and is configured to align to encompass the second portion 110. Each pin of a pair of pins 248 is received by a respective receiving well 252 defined by one of the first side portion 240 and the second side portion 244 to couple the first side portion 240 with the second side portion 244.

Figure 6:
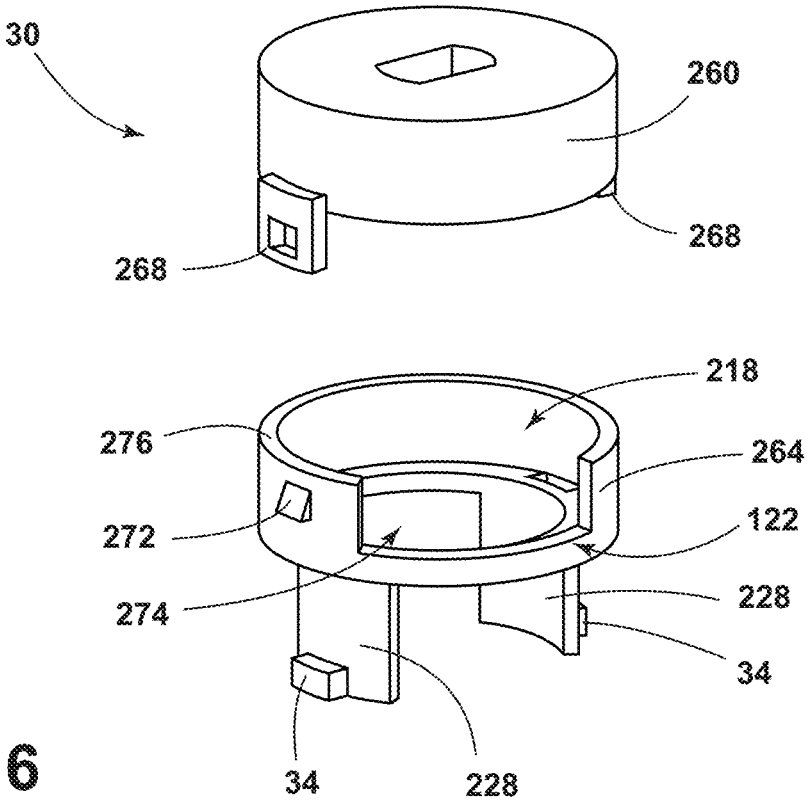
FIG. 6 is an exploded side perspective view of a cap of a power cord assembly, according to some examples.

Referring now to FIG. 6, according to other examples, the cap 30 may include an upper portion 260 and a lower portion 264. The lower portion 264 defines the cavity 218 configured to receive the second portion 110 of the power cord 26. The lower portion 264 further defines the elongated cord opening 122 in communication with the cavity 218. Retaining features 272 are positioned on the lower portion 264 of the cap 30 and may be circumferentially spaced about the lower portion 264. The upper portion 260 includes a pair of clips 268 that extend downward toward the lower portion 264 and are configured to engage with the retaining features 272. When the power cord assembly 64 is assembled, the first portion 108 of the power cord 26 is inserted through an opening 274 defined by the lower portion 264 of the cap 30. The second portion 110 of the power cord 26 is received by the cavity 218 defined by the lower portion 264 of the cap 30, and the cord 114 of the power cord 26 is positioned to extend through the cord opening 122. The upper portion 260 fits over a top edge 276 of the lower portion 264 to encompass the second portion 110 of the power cord 26. When the upper portion 260 is positioned over the lower portion 264, the clips 268 are engaged with the retaining features 272. The engagement of the clips 268 and the retaining features 272 couples the upper portion 260 of the cap 30 to the lower portion 264 of the cap 30. Coupling the upper portion 260 of the cap 30 to the lower portion 264 of the cap 30 secures the power cord 26 within the cavity 218 of the cap 30.

Figure 7:
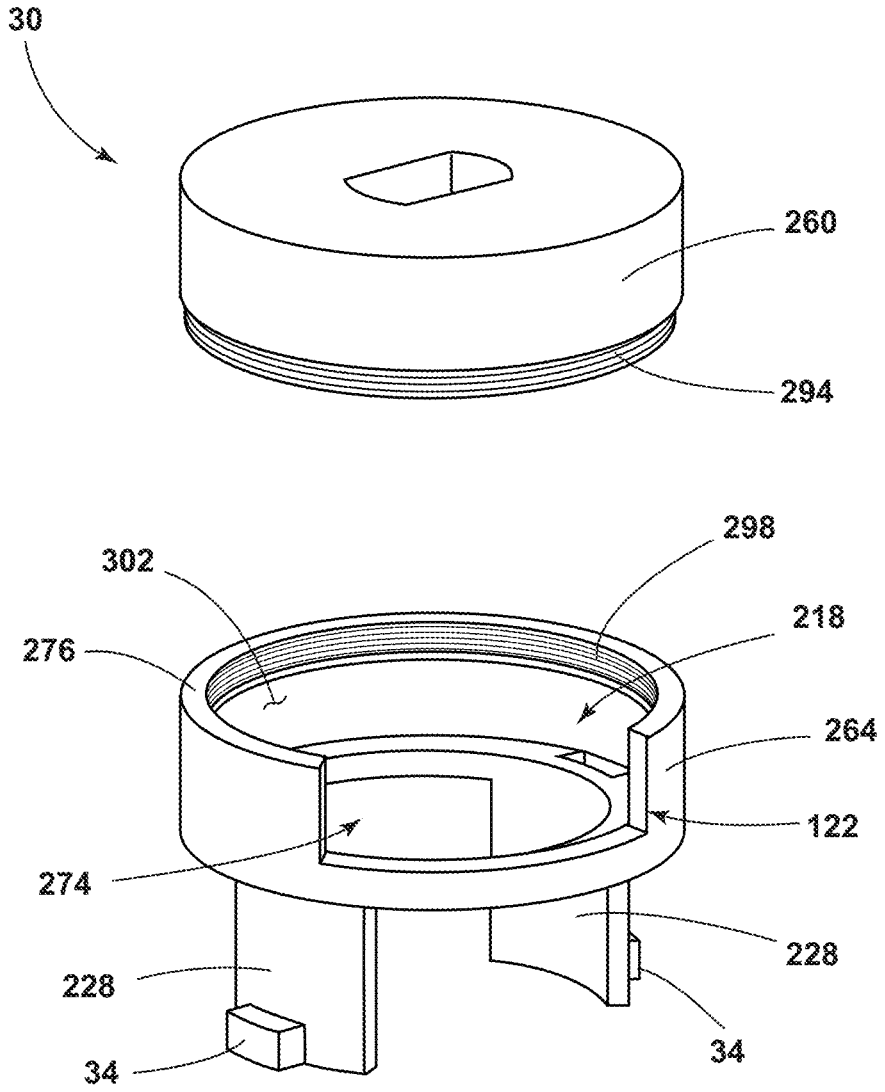
FIG. 7 is an exploded side perspective view of a threaded cap of a power cord assembly, according to some examples.

Referring now to FIG. 7, in still other examples, the cap 30 may include the upper portion 260 and the lower portion 264. The lower portion 264 defines the cavity 218 configured to receive the second portion 110 of the power cord 26. The lower portion 264 further defines the elongated cord opening 122 in communication with the cavity 218. Interior threading 298 is positioned on an inner surface 302 of the lower portion 264. In various examples, the interior threading 298 may extend only partially along the inner surface 302 and into the cavity 218. In other examples, the interior threading 298 may extend along the entirety of the inner surface 302 of the lower portion 264. The upper portion 260 may include exterior threading 294 configured to mate with the interior threading 298 of the lower portion 264. When the power cord assembly 64 is assembled, the first portion 108 of the power cord 26 is inserted through the opening 274 defined by the lower portion 264 of the cap 30. The second portion 110 of the power cord 26 is received by the cavity 218 defined by the cap 30, and the cord 114 of the power cord 26 is positioned to extend through the cord opening 122 defined by the cap 30. The upper portion 260 fits over the top edge 276 of the lower portion 264 and is rotated to mate the exterior threading 294 of the upper portion 260 with the interior threading 298 of the lower portion 264. When the exterior threading 294 and the interior threading 298 are fully mated, the upper portion 260 of the cap 30 is coupled to the lower portion 264 of the cap 30. When the upper portion 260 is coupled to the lower portion 264, the cap 30 is coupled to the power cord 26 and encompasses the second portion 110 of the power cord 26.

Figure 8:
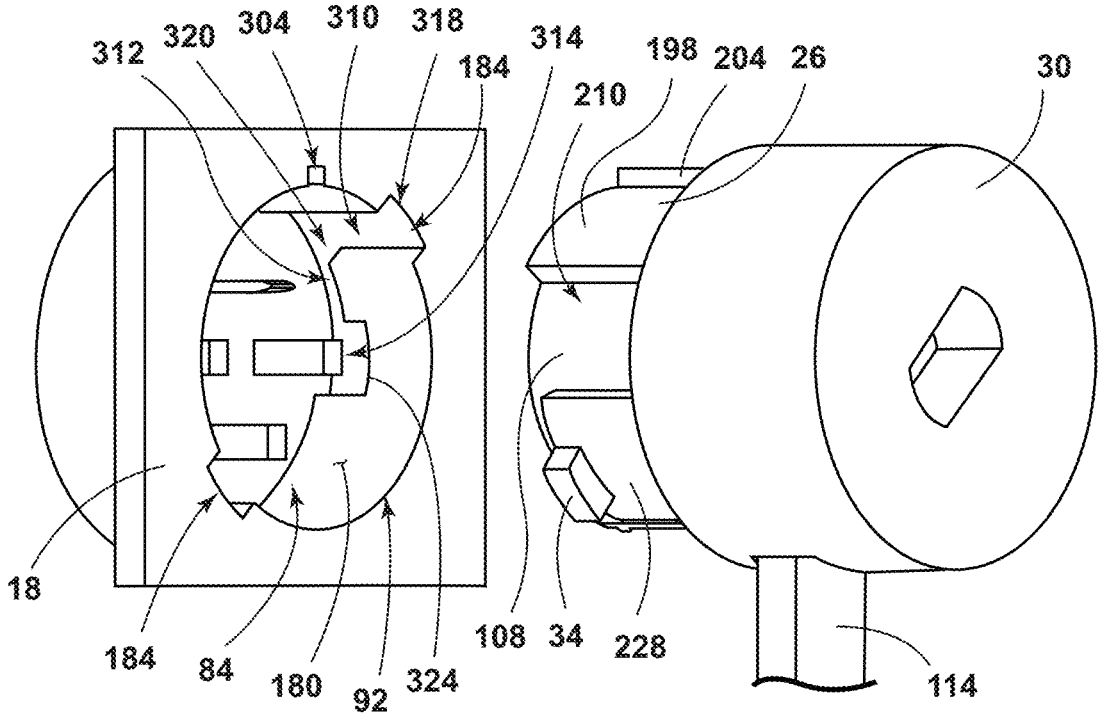
FIG. 8 is a side perspective view of the receptacle assembly of FIG. 3 and the power cord assembly and the cap of FIG. 4A, prior to engagement with the receptacle assembly.

Referring now to FIGS. 8-9B, when the cap 30 is coupled to the power cord 26, the power cord 26 and the cap 30 of the power cord assembly 64 may be at least partially received by the receptacle 18. The receptacle 18 may define a notch 304 in communication with the cavity 84 and configured to receive the tab 204 of the first portion 108 of the power cord 26. When the power cord 26 and the cap 30 are inserted within the cavity 84 of the receptacle 18, the tab 204 of the first portion 108 of the power cord 26 is aligned with the notch 304 of the receptacle 18. The alignment of the tab 204 with the notch 304 is configured to guide insertion of the power cord 26 into the receptacle 18. The first portion 108 of the power cord 26 and the extensions 228 and protrusions 34 of the cap 30 are received by the cavity 84 of the receptacle 18 with the guidance of the tab 204. This provides a poka-yoke keyway to prevent incorrect insertion of the power cord 26 within the receptacle 18. In other words, the tab 204 and the notch 304 may form the poka-yoke keyway.

The receptacle 18 includes the inner wall 180 that defines the cavity 84 and the channel 184 configured to receive the protrusions 34 of the cap 30. The number of channels 184 may correspond to the number of protrusions 34. For example, where there are two protrusions 34, the inner wall 180 may define two channels 184. The channels 184 may further be of a size and shape configured to complement the protrusions 34. For example, where the protrusions 34 have a rectangular shape, the channels 184 may have a rectangular cross-section.

Each channel 184 includes a first portion 310, a second portion 312, and a third portion 314. The first portion 310 includes a first end 318 at the second opening 92 of the receptacle 18 and extends inward toward the back panel 134. The first portion 310 terminates at a second end 320 positioned within the cavity 84 between the second opening 92 and the back panel 134. The second portion 312 of the channel 184 extends from the second end 320 of the first portion 310. In various examples, the second portion 312 may extend perpendicularly to the first portion 310 and may be configured to follow the circumference of the inner wall 180. The second portion 312 extends a predetermined distance along the circumference of the inner wall 180 to form an L-shape with the first portion 310 of the channel 184. The third portion 314 of the channel 184 extends a predetermined distance from an end of the L-shape back toward the second opening 92 of the receptacle 18. Where the second portion 312 extends perpendicularly to the first portion 310, the third portion 314 is parallel to the first portion 310. Further, the third portion 314 forms a stop 324 for the protrusion 34 when the protrusion 34 is received within the channel 184. When the protrusion 34 abuts the stop 324, the cap 30 is in the locked position.

When the protrusions 34 of the cap 30 are received by the respective channels 184, the cap 30 is movable between the locked position and the unlocked position. As illustrated in FIG. 9A, when the cap 30 is in the unlocked position, each protrusion 34 of the cap 30 may be received by the first portion 310 of the respective channel 184. Pressure may be applied to the cap 30 to push each protrusion 34 toward the second end 320 of the first portion 310 of the respective channel 184 against the bias of the spring 38. When each protrusion 34 abuts the second end 320 of the first portion 310 of the respective channel 184, the spring 38 (FIG. 4A) is compressed between the cap 30 and the outer face 118 of the power cord 26. The cap 30 is then rotated so that each protrusion 34 is translated along the second portion 312 of the respective channel 184 in a first direction, as indicated by arrow S in FIG. 9A. When the protrusion 34 is received by the second portion 312 of the respective channel 184, the spring 38 can no longer bias the cap 30 away from the receptacle 18 and the pressure on the cap 30 may be released.

As shown in FIG. 9B, when the protrusions 34 of the cap 30 reach the third portion 314 of the respective channels 184, the spring 38 (FIG. 4A) biases the cap 30 outward, as indicated by arrow T, and moves each protrusion 34 into the third portion 314 of the respective channel 184 until each protrusion 34 abuts the respective stop 324. In other words, the cap 30 is in the locked position when the protrusion 34 is received by the third portion 314. When each protrusion 34 meets the respective stop 324, the cap 30 is maintained in the locked position. The power cord 26 cannot be removed without placing pressure on the cap 30 until the protrusions 34 are aligned with the respective second portion 312 and rotating the cap 30 in a second direction, opposite the first direction, so that the protrusions 34 are received by the respective second portions 312 of the channels 184. When the protrusions 34 are at the second end 320 of the respective first portion 310, the spring 38 is configured to bias the cap 30 into the unlocked position and away from the receptacle 18.

Referring again to FIGS. 9A and 9B, when the cap 30 is in the unlocked position, the cord 114 of the power cord 26 is on a first side 330 of the cord opening 122 of the cap 30. When the cap 30 is rotated to the locked position, the cord 114 of the power cord 26 is moved along the elongated cord opening 122 of the cap 30 and toward a second edge 334 defining the cord opening 122. The cord opening 122 is wide enough to allow the cap 30 to be pressed toward the receptacle 18 without damaging the cord 114, and the cord opening 122 is long enough to allow rotation of the cap 30 without obstruction. It is contemplated that strain relief protection may also be used to prevent inadvertent pressure being applied to the cord 114 as the cap 30 is pressed and released.

Referring now to FIGS. 10 and 11, in some examples, the receptacle assembly 62 is slidably coupled with the mounting plate 22. The mounting plate 22 may include a first retention member 340, a second retention member 342, and a third retention member 344 positioned circumferentially around the first opening 96. Each of the retention members 340, 342, 344 may be generally L-shaped. The first retention member 340, the second retention member 342, and the third retention member 344 are positioned extending inward toward a center of the first opening 96. When the receptacle 18 is slid into engagement with the mounting plate 22, each of the retention members 340, 342, 344 are positioned to extend over and abut the rear surface 100 of the edge plate 160 of the receptacle 18.

The clips 168 of the receptacle 18 extend from a side of the edge plate 160 opposite the second retention member 342 of the mounting plate 22. Each of the clips 168 is engaged with receiving spaces 348 positioned on the side of the first opening 96 opposite the second retention member 342. For example, the clips 168 may be snap-engaged with the receiving spaces 348.

As illustrated in FIGS. 10-13, the switch 42 is coupled to the rear surface 100 of the receptacle 18 by at least one fastener 352. A cantilever member 356 is rotatably coupled with the receptacle 18 proximate the switch 42. The cantilever member 356 includes an upper end 368, extending outward to form a foot, and an extension 380. A pin 364 extends through the cantilever member 356 to couple the cantilever member 356 with the receptacle 18. One of the channels 184 defined by the receptacle 18 is configured to at least partially house the cantilever member 356. The cantilever member 356 may be at least partially positioned within a slot 360 defined by the receptacle 18 and in communication with the third portion 314 of the channel 184.

Figure 12:
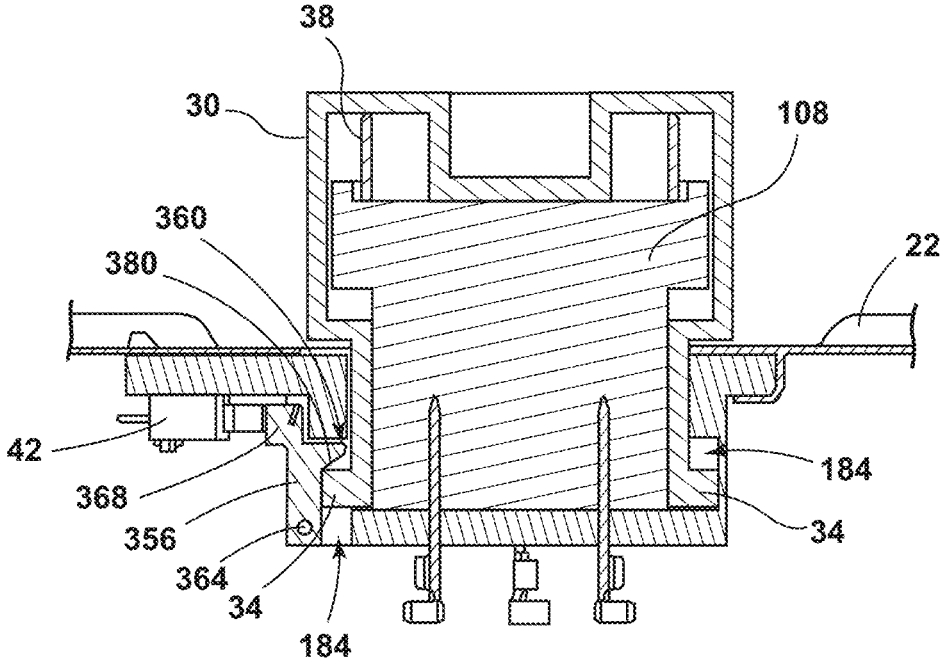
FIG. 12 is a cross-sectional view of the power connection assembly and switch of FIG. 11 taken along line A-A when the switch is disengaged.
Figure 13:
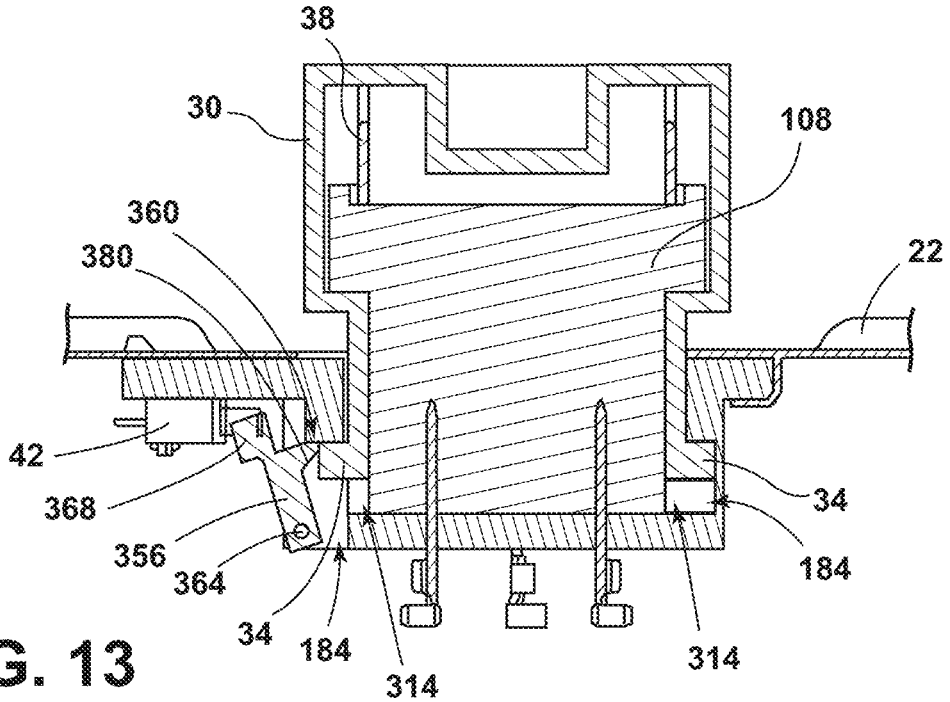
FIG. 13 is a cross-sectional view of the power connection assembly and switch of FIG. 11 taken along line A-A when the switch is engaged.

Referring now to FIGS. 12 and 13, the cantilever member 356 is configured to pivot about the pin 364 between a first position (FIG. 12) and a second position (FIG. 13). In some examples, when the power cord assembly 64 is engaged with the receptacle assembly 62, the protrusions 34 of the cap 30 are received in the channel 184. When the cap 30 is in the unlocked position, the cantilever member 356 is positioned upright in a first position within the slot 360 (FIG. 12). When the cantilever member 356 is in the first position, the upper end 368 of the cantilever member 356 is disengaged from the switch 42. When the protrusions 34 are rotated into the third portion 314 of the respective channels 184, one of the protrusions 34 rotates to contact the extension 380 of the cantilever member 356. In some examples, the extension 380 may be wedge-shaped. The extension 380 is generally angled so that, when the protrusion 34 contacts the extension 380, the cantilever member 356 is pushed outward into the second position (FIG. 13). When the cantilever member 356 is in the second position, the upper end 368 of the cantilever member 356 is pushed outward and is subsequently engaged with the switch 42 to provide a flow of electricity through the power cord 26 to the appliance 14.

Figure 14A:
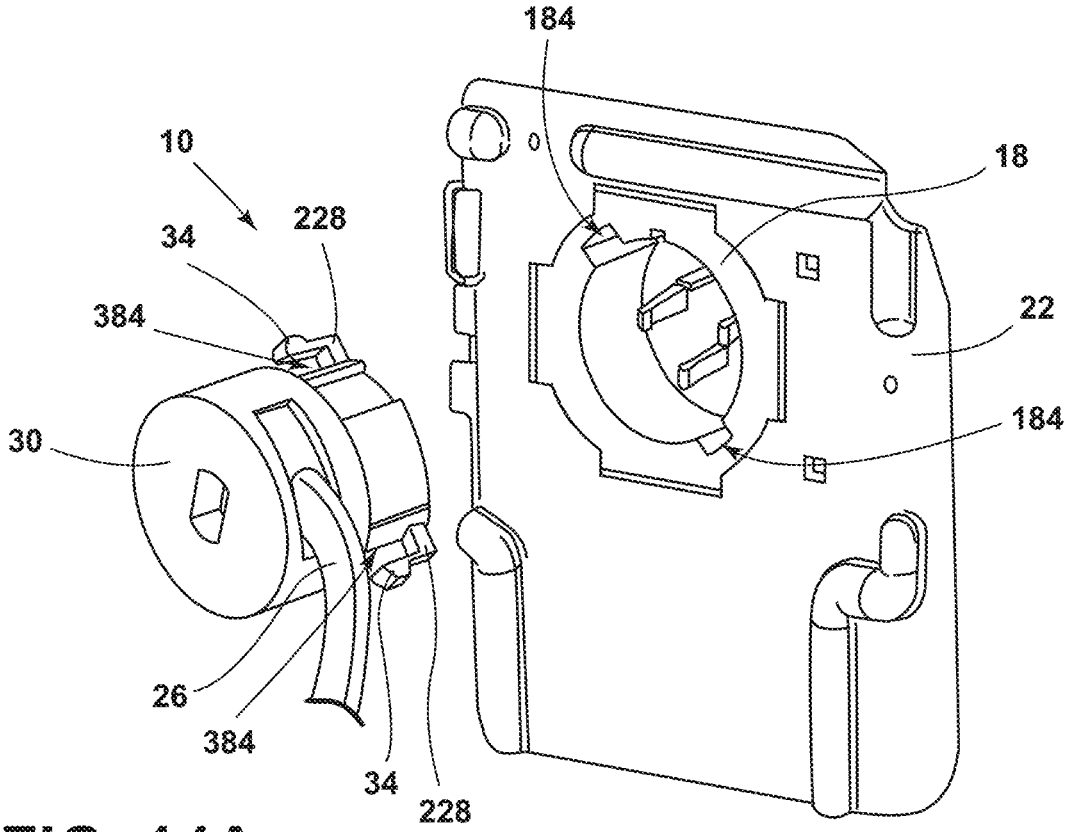
FIG. 14A is a side perspective view of a power connection assembly including a power cord assembly prior to engagement with a receptacle assembly, according to some examples.
Figure 14B:
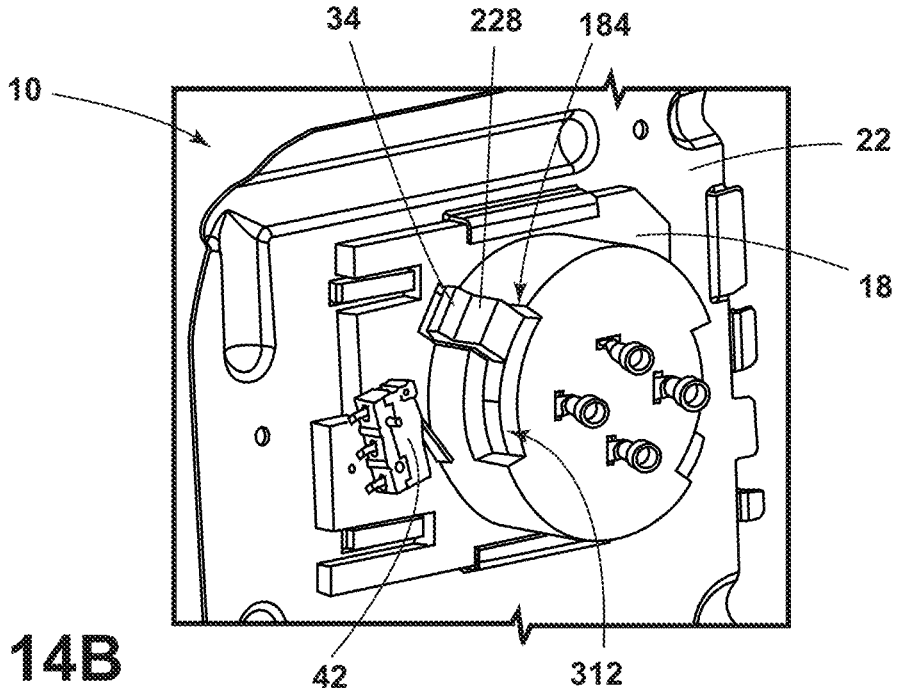
FIG. 14B is a rear perspective view of the power connection assembly of FIG. 14A with the power cord assembly engaged with the receptacle assembly and in a first position.
Figure 14C:
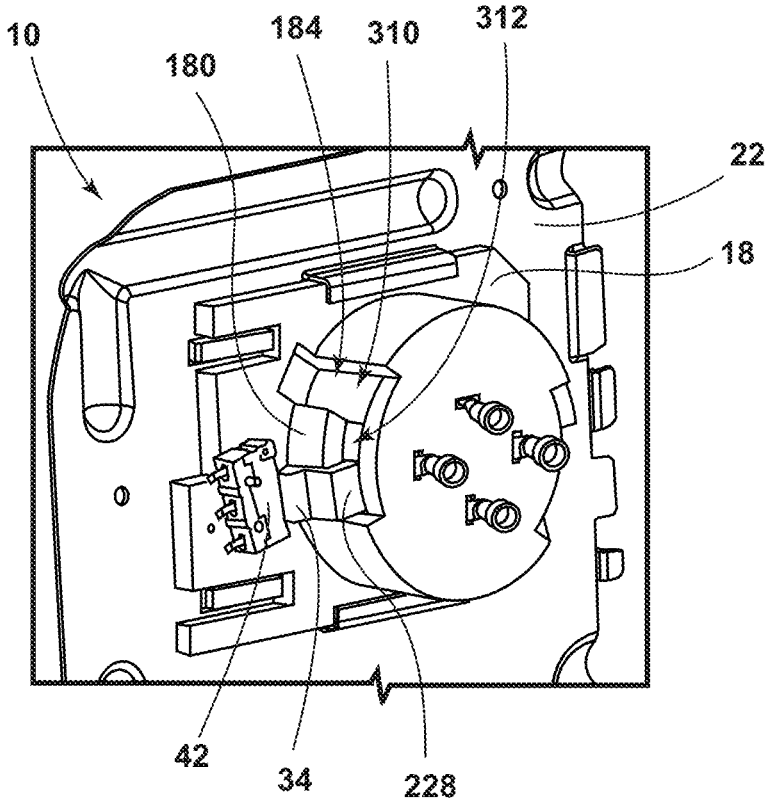
FIG. 14C is a rear perspective view of the power connection assembly of FIG. 14A with the power cord assembly engaged with the receptacle assembly and in a second position.

Referring now to FIGS. 14A-14C, in some examples, the extensions 228 of the cap 30 may be generally hook-shaped. Each of the channels 184 may include only the first portion 310 and the second portion 312. The first portion 310 of each channel 184 may be configured as a slot to at least partially receive the extensions 228 and protrusions 34 of the cap 30. The inner wall 180 of the receptacle 18 may be configured to be received by a space 384 defined by the extensions 228. When the extensions 228 are rotated over the inner wall 180 and along the respective second portions 312, one of the protrusions 34 may directly engage the switch 42 to move the switch 42 to the closed position.

Figure 15:
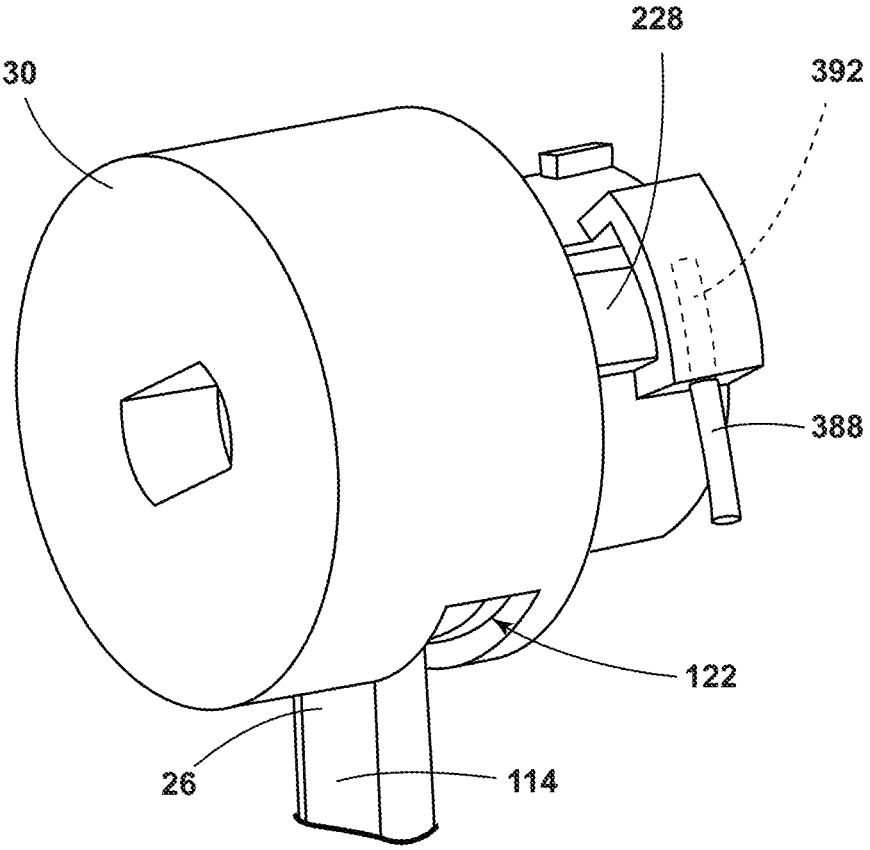
FIG. 15 is a side perspective view of a power cord assembly having an engagement pin, according to some examples.

In other examples, as illustrated in FIG. 15, the protrusion 34 may actuate a pin 388 when rotated. The pin 388 may be selectively movable inward and outward of a sleeve 392 positioned on the cap 30. When the pin 388 extends outward of the sleeve 392, the pin 388 may engage with the switch 42 to close the circuit and allow a flow of electricity through the power connection assembly 10. In other words, the protrusion 34 is configured to engage with the pin 388 when the cap 30 is in the locked position, and the pin 388 may actuate the switch 42.

Figure 16:
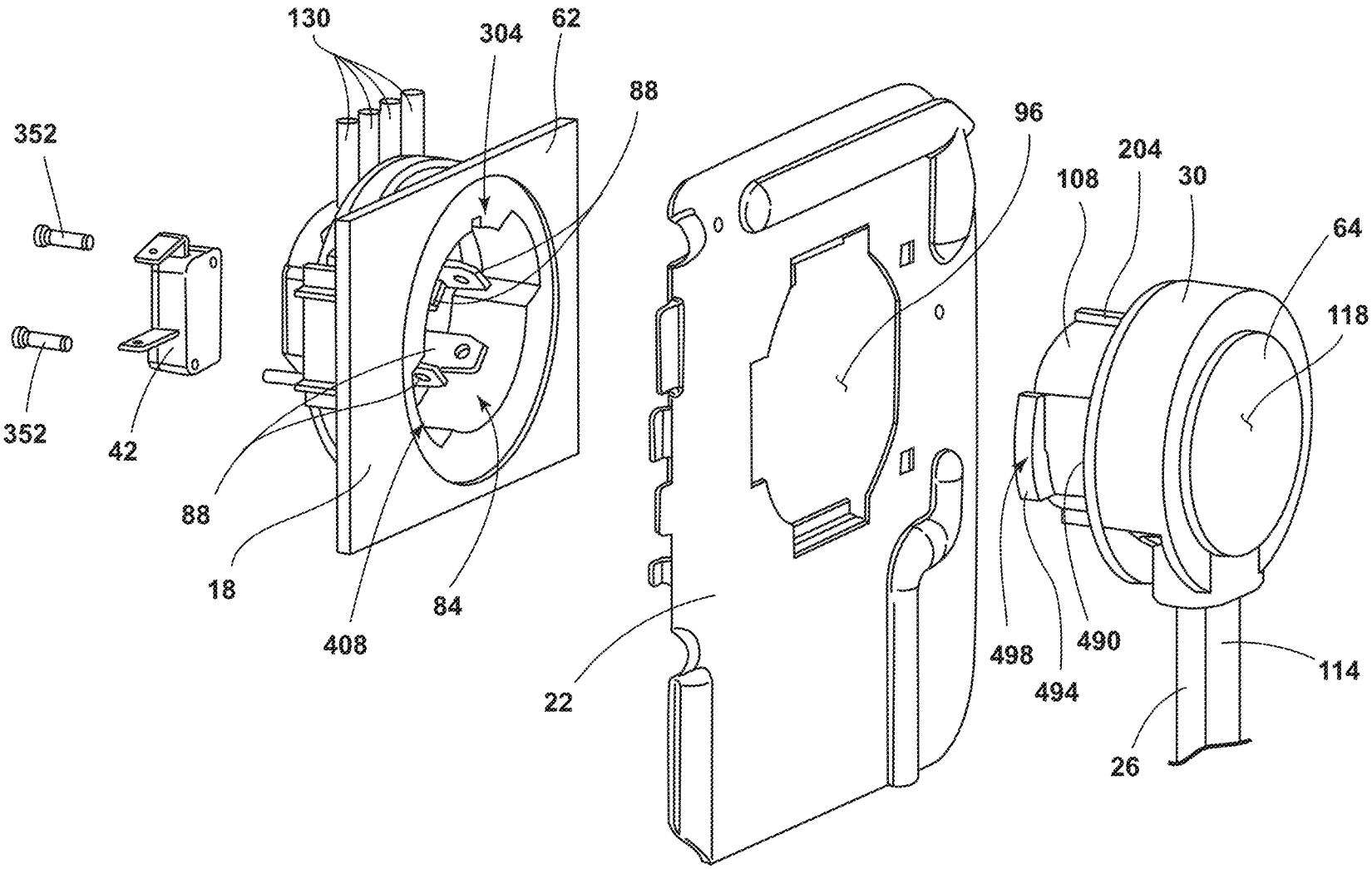
FIG. 16 is an exploded top perspective view of a power connection assembly including a receptacle assembly and a power cord assembly, according to some examples.
Figure 17:
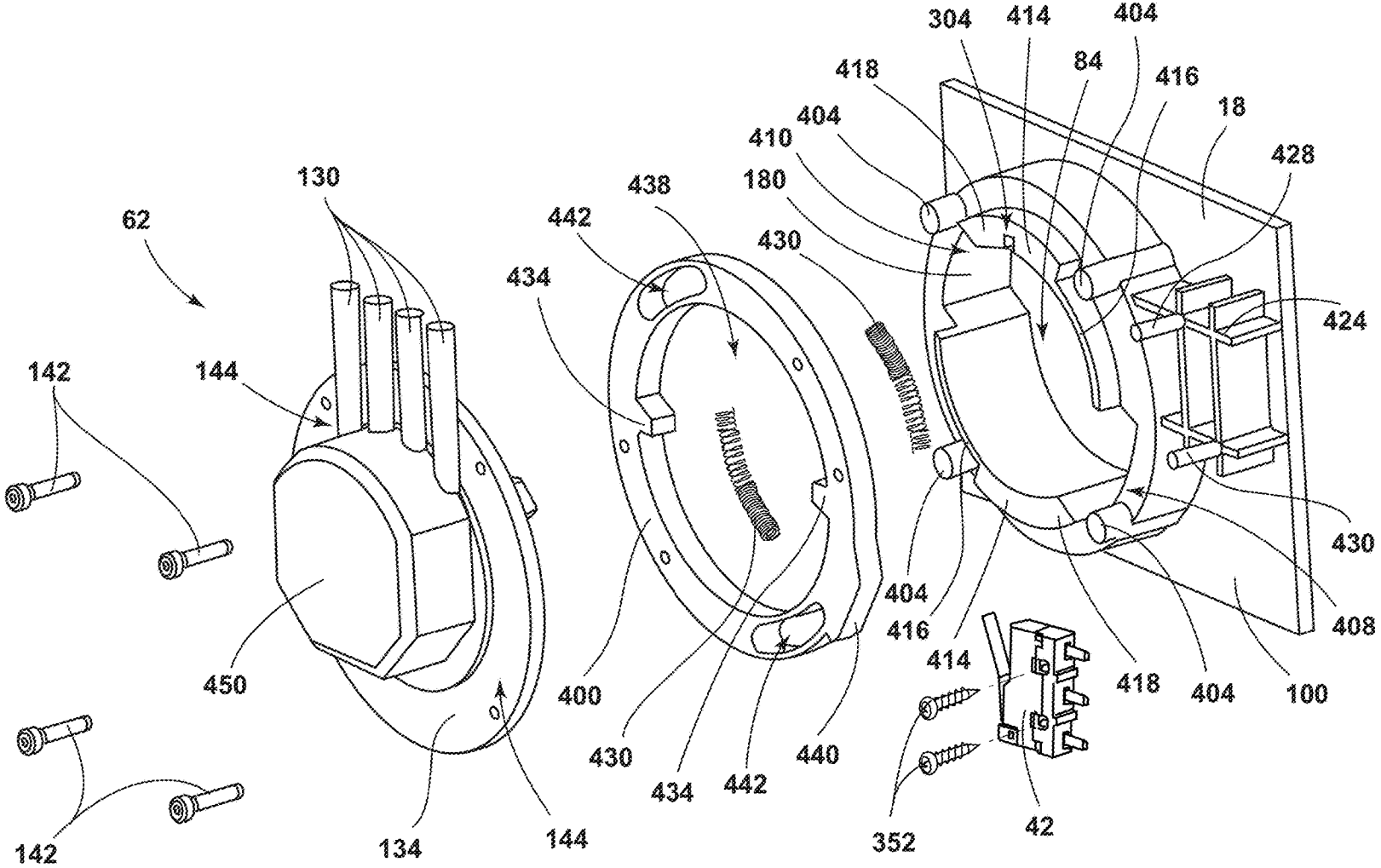
FIG. 17 is an exploded top perspective view of the receptacle assembly of FIG. 16.

Referring now to FIGS. 16 and 17, the receptacle assembly 62 is illustrated according to another example and includes a spring-loaded ring 400. The receptacle assembly 62 further includes the receptacle 18 that has the inner wall 180 that defines the cavity 84. The inner wall 180 includes guide posts 404 extending rearward of the receptacle 18 and spaced evenly about the circumference of the inner wall 180. The guide posts 404 are configured to guide rotation of the spring-loaded ring 400.

Figure 19A:
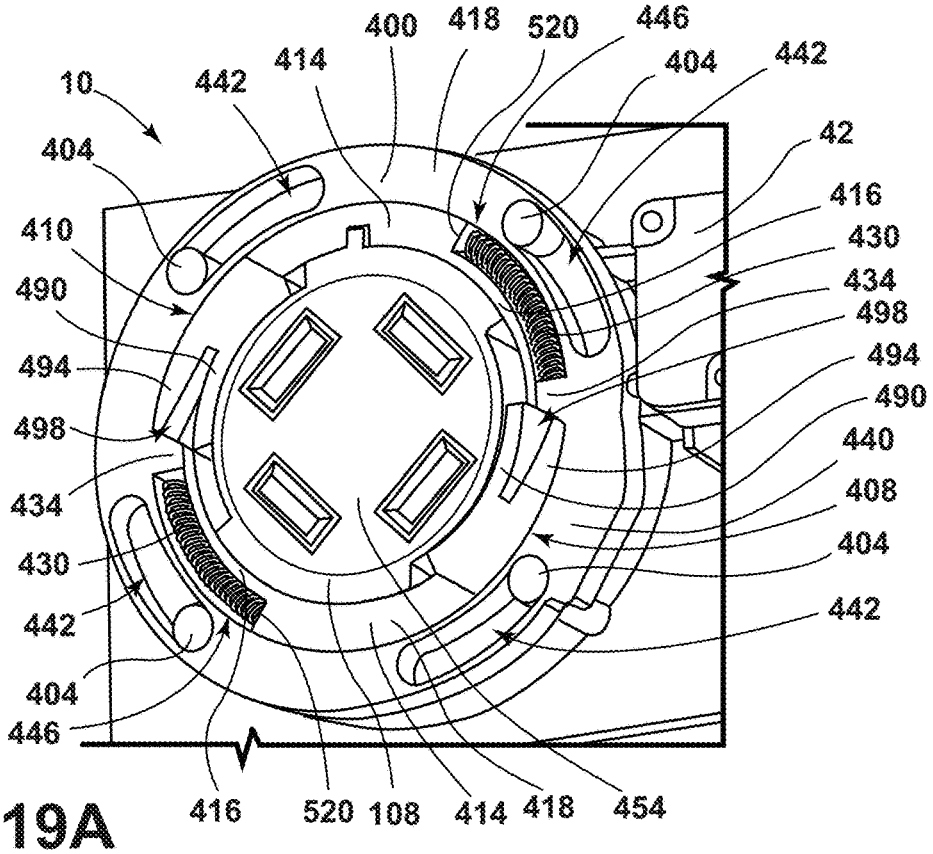
FIG. 19A is a partial rear perspective view of a power connection assembly, according to some examples, including a power cord assembly received by a receptacle assembly in a first position.
Figure 19B:
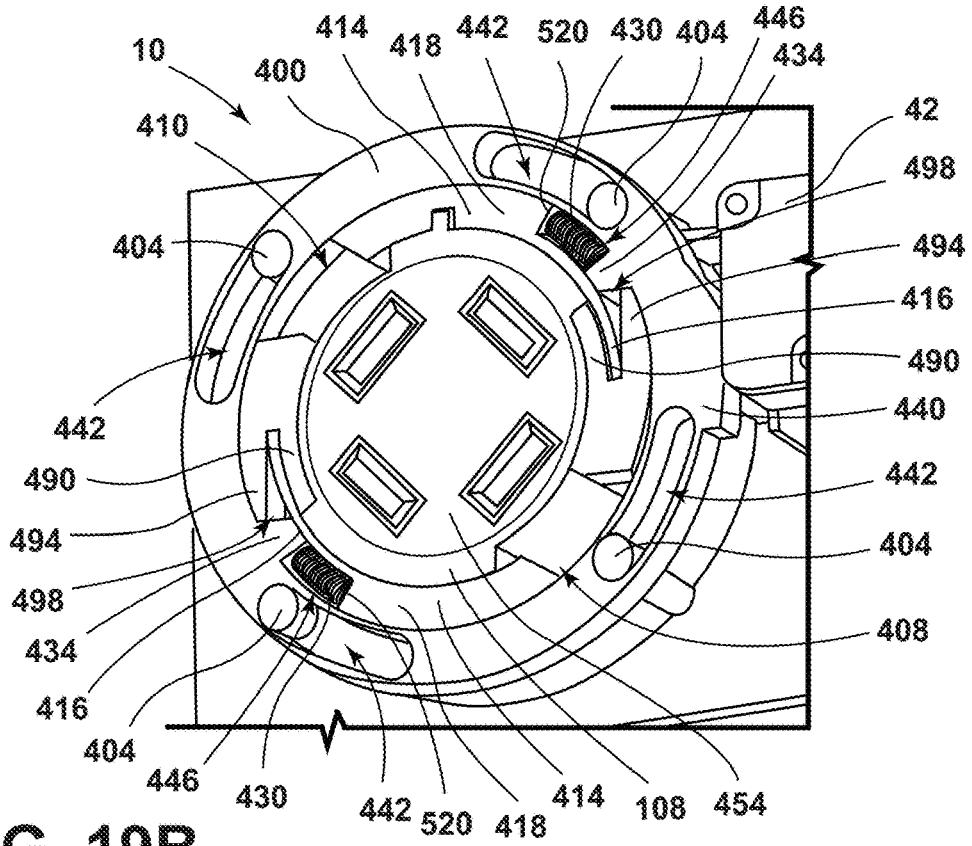
FIG. 19B is a partial rear perspective view of the power connection assembly of FIG. 19A with the power cord assembly received by the receptacle assembly in a second position.

The inner wall 180 further defines first and second channels 408, 410 positioned laterally across the cavity 84 from one another. A perimeter wall 414 extends rearwardly from the inner wall 180 and is positioned between the first and second channels 408, 410. In various examples, the inner wall 180 may include more than one perimeter wall 414, such as, for example, a pair of perimeter walls 414. Each perimeter wall 414 has a first portion 416 and a second portion 418. The first portion 416 may be narrower than the second portion 418. The second portion 418 of at least one of the perimeter walls 414 may define the notch 304 configured to guide the power cord 26 into engagement with the receptacle 18 (FIGS. 19A and 19B). As discussed above, the notch 304 may be configured to receive the tab 204 of the power cord 26 (FIGS. 19A and 19B).

With reference again to FIGS. 16 and 17, the receptacle 18 may further include a mount 424 for the switch 42. The mount 424 includes receiving posts 428 that extend rearward from the rear surface 100 of the receptacle 18. The receiving posts 428 of the mount 424 may be of a predetermined height to position the switch 42 at the same height as the perimeter walls 414 of the inner wall 180. The mount 424 can include a solid surface or various crossed supports and may be of any size or shape to support the switch 42. The switch 42 may be coupled with the mounting plate 22 using fasteners 352. Each of the fasteners 352 may be received by one of the receiving posts 428 to couple the switch 42 with the rear surface 100 of the receptacle 18 and position the switch 42 proximate one of the perimeter walls 414. In other examples, the switch 42 may be integrally formed with the receptacle 18.

The spring-loaded ring 400 is positioned to align with the inner wall 180 of the receptacle 18 and to be flush with the inner wall 180 when the spring-loaded ring 400 is coupled with the receptacle 18. The spring-loaded ring 400 may have an inner circumference equivalent to the circumference of the cavity 84 of the receptacle 18 and a thickness equivalent to a distance spanned by the guide posts 404 that extend rearward of the receptacle 18. The spring-loaded ring 400 defines an opening 438 that may be configured to at least partially receive the receptacle 18. For example, the opening 438 may be sized to receive the perimeter wall 414 of the receptacle 18. Alternatively, the opening 438 may be aligned with the second opening 92 of the receptacle 18. The spring-loaded ring 400 may further define a plurality of guide slots 442 each having a generally elliptical or obround shape. Each of the plurality of guide slots 442 is configured to receive a respective guide post 404 of the receptacle 18. When the spring-loaded ring 400 is rotated, the guide slots 442 are configured to prevent over-rotation of the spring-loaded ring 400.

The spring-loaded ring 400 may include at least one stop 434 that extends inward toward a center axis of the opening 438. In some examples, the at least one stop 434 may include two or more stops 434. Where there are two stops 434, as illustrated in FIG. 17, the stops 434 are generally positioned laterally across the opening 438 from one another. Each stop 434 includes an edge and extends radially from the spring-loaded ring 400. Each stop 434 is positioned so that the edge is aligned with an end of the first portion 416 of one of the perimeter walls 414.

As illustrated in FIGS. 17, 19A, and 19B, the spring-loaded ring 400 includes at least one spring 430 positioned to abut each of the stops 434. The number of springs 430 may be equal to the number of stops 434. Each of the springs 430 is positioned within a respective spring slot 446 between the edge of a respective stop 434 and an end 520 of the second portion 418 of a respective perimeter wall 414 of the receptacle 18. The stop 434, the end 520 of the second portion 418 of the perimeter wall 414, and the spring-loaded ring 400 are positioned to define each of the spring slots 446 configured to receive the springs 430 of the spring-loaded ring 400. In other words, the spring-loaded ring 400 is positioned to align with the receptacle 18 and includes a spring 430 disposed within a spring slot 446, wherein the spring slot 446 is defined by the perimeter wall 414 of the receptacle 18 and the spring-loaded ring 400.

As illustrated in FIG. 17, a projection 440 may be positioned proximate one of the stops 434 and may extend outward, normal to the circumference of the spring-loaded ring 400, in a direction opposite the stop 434. The projection 440 is positioned to engage with the switch 42 when the spring-loaded ring 400 is rotated into a compressed position. In other words, when the receptacle assembly 62 is assembled, the projection 440 is positioned proximate the switch 42 and is selectively engageable with the switch 42. When the projection 440 engages the switch 42, the engagement of the projection 440 with the switch 42 moves the switch 42 to the closed position, as discussed in more detail herein (FIGS. 19A and 19B). In various examples, the switch 42 may be integral with the receptacle 18 and may be selectively engaged by the projection 440 and/or the spring-loaded ring 400.

Referring again to FIGS. 16 and 17, the back panel 134 may include the electrical wiring 130 and the plurality of prongs 88. The receptacle 18 may include a cover 450 centrally positioned over the back panel 134 and configured to protect the connection between the electrical wiring 130 and the plurality of prongs 88. The back panel 134 further includes the plurality of apertures 144 configured to receive the plurality of fasteners 142 to operably couple the back panel 134 to the receptacle 18. The fastener 142 may operably couple the back panel 134 to the guide posts 404 or to the rear surface 100 of the receptacle. Coupling the back panel 134 with the receptacle 18 couples the spring-loaded ring 400 and the springs 430 to the receptacle 18 by positioning the spring-loaded ring 400 and the springs 430 between the back panel 134 and the receptacle 18.

Figure 18:
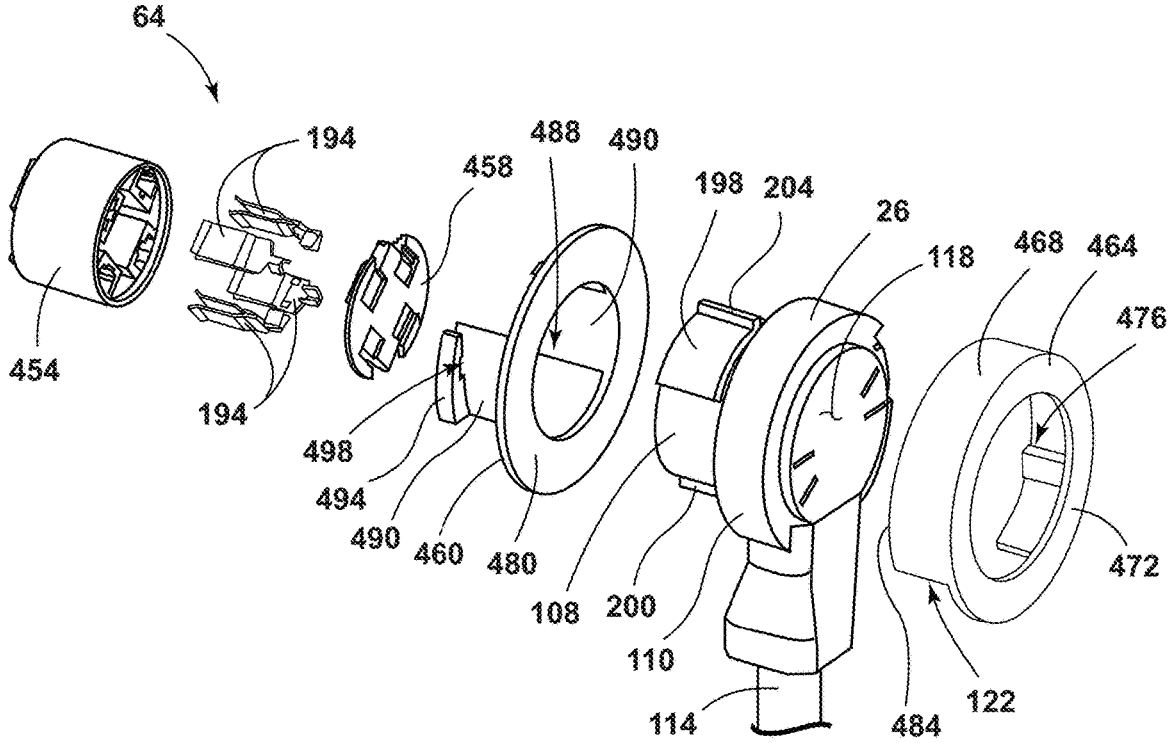
FIG. 18 is an exploded top perspective view of the power cord assembly of FIG. 16.

Referring now to FIGS. 16 and 18, the power cord assembly 64 includes the power cord 26 and the cap 30 positioned over the power cord 26. The power cord 26 includes the first portion 108 that extends from the second portion 110, as described previously. The second portion 110 includes the cord 114 and the outer face 118. The first portion 108 is configured to receive the plurality of prongs 88 of the receptacle 18. The first portion 108 may include a housing 454 that includes the plurality of receiving members 194 positioned in the same configuration as the plurality of prongs 88. The housing 454 includes a housing back panel 458 configured to enclose the plurality of receiving members 194 within the housing 454. The housing 454 may be generally cylindrical, and the housing back panel 458 may be generally circular to complement the housing 454. However, it is contemplated that the housing 454 may be any shape, for example, a cube or a rectangular prism, and the housing back panel 458 may be adjusted to fit the housing 454. The housing 454, the plurality of receiving members 194, and the housing back panel 458 are configured to be inserted within the cavity 84 of the receptacle 18 to receive the plurality of prongs 88.

As illustrated in FIG. 18, in various examples, the plurality of receiving members 194 may be configured as female electrical connectors positioned to receive the plurality of prongs 88. In other examples, the plurality of receiving members 194 may be defined by the housing 454, or the plurality of receiving members 194 may be defined by members extending from the first portion 108 of the power cord 26. It is contemplated that the plurality of receiving members 194 may be positioned within the first portion 108 of the power cord 26 without the housing 454. Each of the plurality of receiving members 194 receives the respective prong 88 as the first portion 108 of the power cord 26 is received by the cavity 84 of the receptacle 18. In other words, the power cord 26 defines the plurality of receiving members 194 configured to receive the plurality of prongs 88 that extend from the receptacle 18.

The first portion 108 of the power cord 26 further includes the opposing first and second guide protrusions 198, 200 positioned to laterally extend from the first portion 108, as discussed previously. Each of the first and second guide protrusions 198, 200 is generally wedge-shaped when viewed from the rear of the power cord 26 and extends circumferentially about the first portion 108. The first guide protrusion 198 includes the tab 204 positioned vertically and configured to guide insertion of the power cord 26 within the receptacle 18. The first and second guide protrusions 198, 200 are positioned to form first and second spaces 208, 210 configured to receive portions of the cap 30 when the cap 30 is positioned over the power cord 26.

Still referring to FIG. 18, in various examples, the cap 30 of the power cord assembly 64 may have an inner portion 460 and an outer portion 464. The outer portion 464 is operably coupled with the inner portion 460 to couple the cap 30 with the power cord 26. The outer portion 464 may include a circumferential wall 468 and an upper rim 472. The circumferential wall 468 defines the cord opening 122 configured to receive the cord 114 of the power cord 26 when the cap 30 is coupled with the power cord 26. The upper rim 472 defines an outer opening 476 configured to be positioned over and/or substantially flush with the outer face 118 of the second portion 110 of the power cord 26.

The inner portion 460 of the cap 30 includes an inner rim 480 configured to sit flush with an edge 484 of the circumferential wall 468 of the outer portion 464. The inner rim 480 defines an inner opening 488 configured to receive the first portion 108 of the power cord 26 when the cap 30 is coupled with the power cord 26. The inner portion 460 of the cap 30 further includes extensions 490 positioned laterally across the inner opening 488 from one another. The extensions 490 may extend circumferentially along at least part of the inner rim 480 and may be configured to be received by the first and second spaces 208, 210 of the first portion 108 of the power cord 26. Each of the extensions 490 includes a protrusion 494 that extends tangentially to the respective extension 490. The extension 490 and the corresponding protrusion 494 define a cap slot 498 configured to engage with the receptacle 18. In other words, the protrusions 494 that extend from the inner portion 460 of the cap 30 and the inner portion 460 of the cap 30 define a cap slot 498. In various examples, the cap 30 may be fixedly coupled to or integrally formed with the power cord 26 as a housing.

Referring now to FIGS. 19A and 19B, the cap 30 and the protrusions 494 are rotatable between the unlocked position and the locked position within the receptacle 18, and the spring-loaded ring 400 is rotatable between the neutral position (FIG. 19A) and the compressed position (FIG. 19B). The neutral position of the spring-loaded ring 400 is related to the unlocked position of the cap 30, and the compressed position of the spring-loaded ring 400 is related to the locked position of the cap 30.

As illustrated in FIG. 19A, when the cap 30 is in the unlocked position, the spring-loaded ring 400 and the springs 430 are in the neutral position. The protrusions 494 of the cap 30 are received by the first and second channels 408, 410, such that each of the cap slots 498 align with the respective first portion 416 of one of the perimeter walls 414. In other words, the receptacle 18 defines channels 408, 410, and the channels 408, 410 are each configured to receive a protrusion 494 of the cap 30. The channels 408, 410 are defined so that each protrusion 494 is aligned with and/or abuts one of the stops 434 of the spring-loaded ring 400. Each of the springs 430 is positioned within the respective spring slot 446 between the respective stop 434 and an end 520 of the second portion 418 of the perimeter wall 414 of the receptacle 18. At least one of the guide posts 404 is positioned to abut a first end of the respective guide slot 442, partially securing the spring-loaded ring 400 to the receptacle 18.

As illustrated in FIG. 19B, when the cap 30 is rotated into the locked position, the cap slot 498 defined by each of the extensions 490 and the respective protrusion 494 of the cap 30 receives the respective first portion 416 of one of the perimeter walls 414. As the cap slots 498 receive the first portions 416 of the perimeter walls 414, an end of each protrusion 494 engages the respective stop 434 of the spring-loaded ring 400. The rotation of the cap 30 applies a circumferential force to the stops 434 and rotates the spring-loaded ring 400. In other words, the spring-loaded ring 400 is engaged with the protrusion 494 when the cap 30 is in the locked position. As the spring-loaded ring 400 rotates in conjunction with the cap 30, the springs 430 are compressed between the stops 434 and the ends 520 of the respective second portion 418 of the perimeter wall 414. In other words, the perimeter wall 414 of the receptacle 18 is configured to be received by the cap slot 498 and the protrusion 494 of the cap 30 is configured to be received by the spring slot 446 when the cap 30 is in the locked position, according to some examples. The guide slots 442 are positioned to facilitate the rotation of the spring-loaded ring 400 relative to the receptacle 18, and each of the guide posts 404 moves from the first end of the respective guide slot 442 to abut an opposite end of the respective guide slot 442. The projection 440 of the spring-loaded ring 400 is also rotated in conjunction with the spring-loaded ring 400. When the spring-loaded ring 400 is in the compressed position, the projection 440 engages the switch 42 and moves the switch 42 to the closed position, closing the circuit and providing a flow of electricity from the power cord 26 to the appliance 14.

Figure 20A:
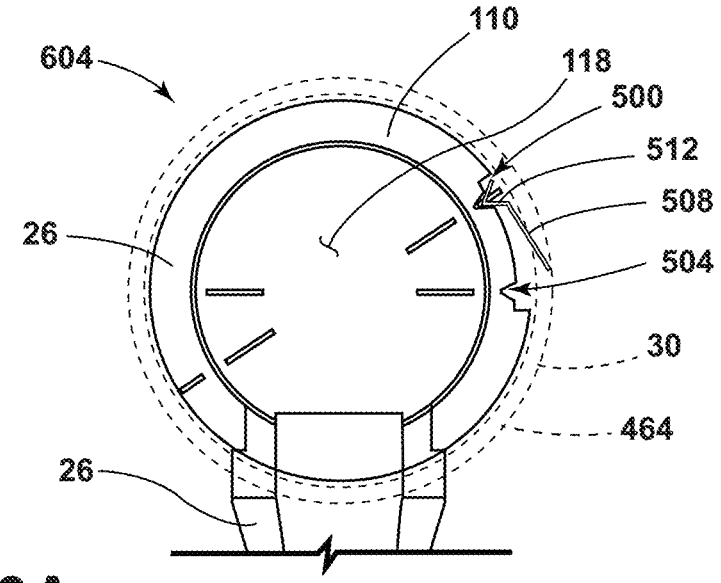
FIG. 20A is a front elevational view of a power connection assembly and a cap for a power cord assembly, according to some examples, with an outer portion of the cap shown in phantom and a detent spring in a first position.
Figure 20B:
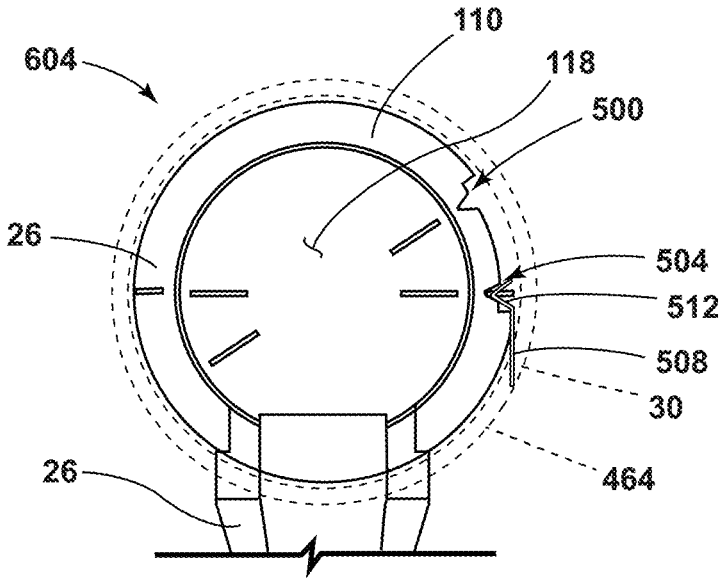
FIG. 20B is a front elevational view of the power connection assembly and the cap of FIG. 20A, with the detent spring in a second position.

Referring now to FIGS. 20A and 20B, a locking assembly 604 may be positioned within the outer portion 464 of the cap 30 to maintain the cap 30 in the locked position. In various examples, the second portion 110 of the power cord 26 defines a first notch 500 and a second notch 504 spaced apart along the circumference of the second portion 110. The first notch 500 and the second notch 504 are selectively engageable with a detent spring 508 coupled with the outer portion 464 of the cap 30. In other words, the locking assembly 604 is a detent spring 508, according to some examples. The detent spring 508 includes an engagement end 512 configured to be received by one of the first notch 500 and the second notch 504. When the engagement end 512 of the detent spring 508 is received by the first notch 500, the cap 30, and the protrusions 494, are in the unlocked position (FIGS. 19A and 20A). When the engagement end 512 of the detent spring 508 is received by the second notch 504, the cap 30, and the protrusions 494, are in the locked position (FIGS. 19B and 20B). The detent spring 508 secures the cap 30 and the protrusions 494 in the locked position, preventing inadvertent movement of the cap 30 to the unlocked position and/or inadvertent release of the power connection assembly 10. In other words, the cap 30 includes the detent spring 508 configured to lock the cap 30 in the locked position. In other examples, the detent spring 508 may be replaced with a locking extension 516 and receiving spaces 518 (FIGS. 25A-26), as discussed elsewhere herein. It is contemplated that the detent spring 508 may be positioned within the receptacle 18 or within the cap 30 without departing from the scope of the present disclosure. In another aspect of this disclosure, the cap 30 and/or the locking assembly 604 may be used to couple the power cord assembly 64 with the receptacle assembly 62. It is conceived that there may be no switch 42 in this configuration or that the switch 42 may be closed by another method (i.e., a user manually closing the switch 42 by an external lever).

Figure 21:
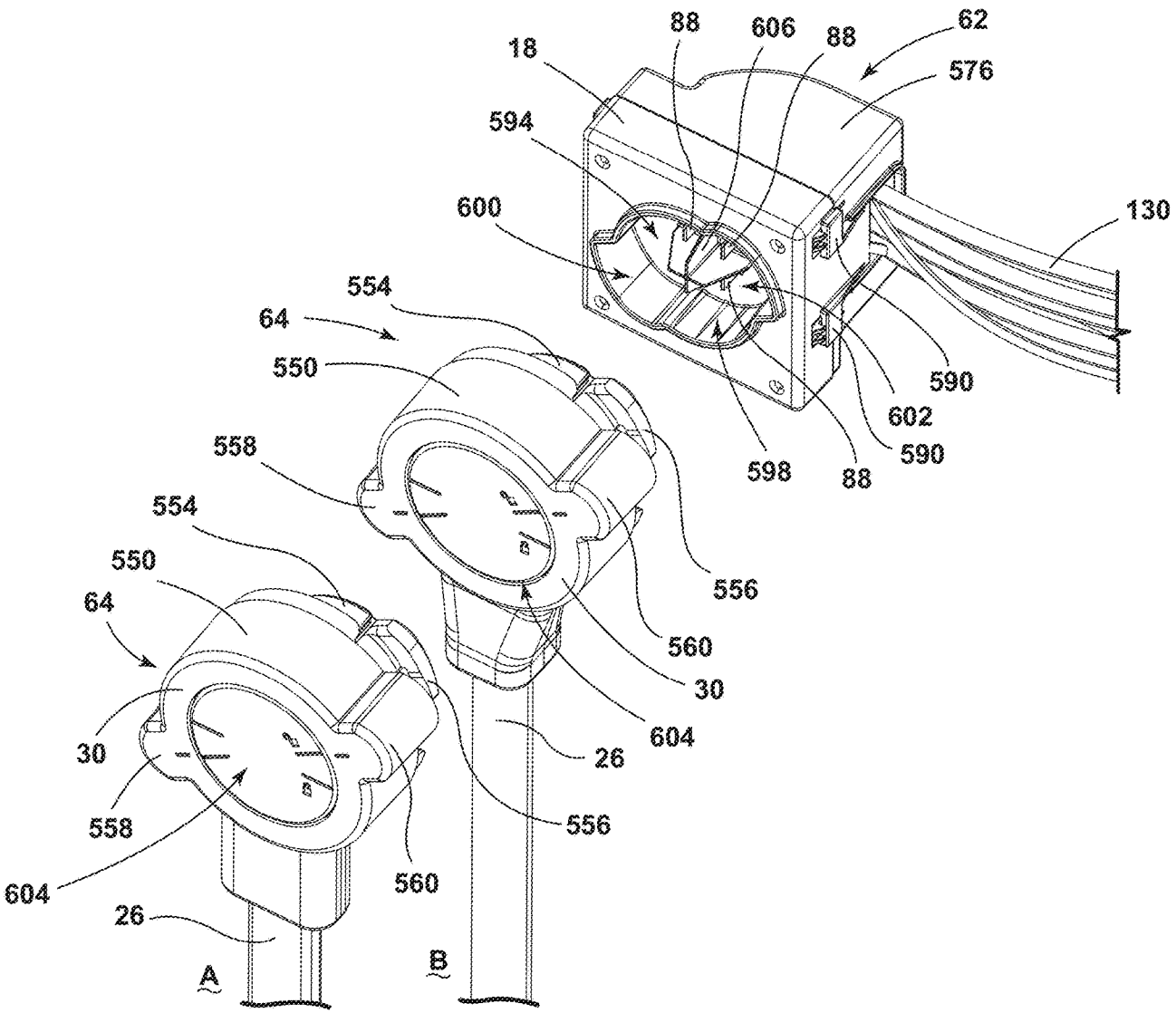
FIG. 21 is a top perspective view of a power connection assembly having a 3-wire power cord assembly and a 4-wire power cord plug assembly prior to selective engagement with a receptacle assembly.

Referring now to FIG. 21, the power cord assembly 64 that has power cord 26 having a three-wire configuration A, a power cord assembly 64 that has a power cord 26 having a four-wire configuration B, and a receptacle assembly 62 are illustrated, according to various examples. The overall configuration and assembly of the power cord assembly 64 that includes the power cord 26 having the three-wire configuration A and the power cord assembly 64 that includes the power cord 26 having the four-wire configuration B are the same and described concurrently throughout as "the power cord assembly 64." The power cord assembly 64 includes the power cord 26 and the cap 30. It will be understood that the cap 30 may be replaced with a housing integrally formed with the power cord 26 without departing from the scope of the disclosure. As discussed previously, the power cord assembly 64 is configured to mate with the receptacle assembly 62 to form the power connection assembly 10 to provide power to the appliance 14 (see FIG. 1).

Figure 22A:
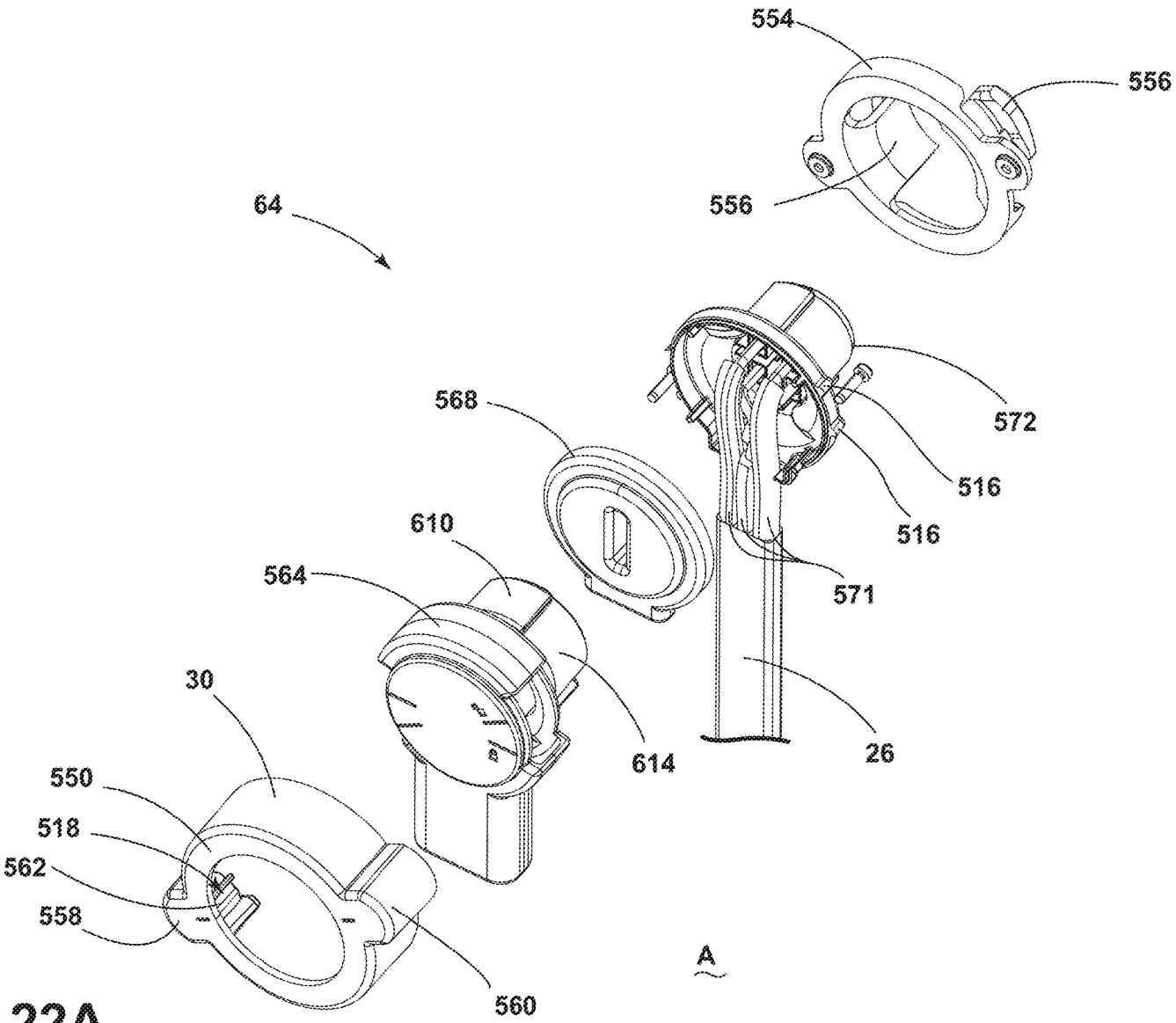
FIG. 22A is an exploded partial top perspective view of the 3-wire power cord assembly of FIG. 21.
Figure 22B:
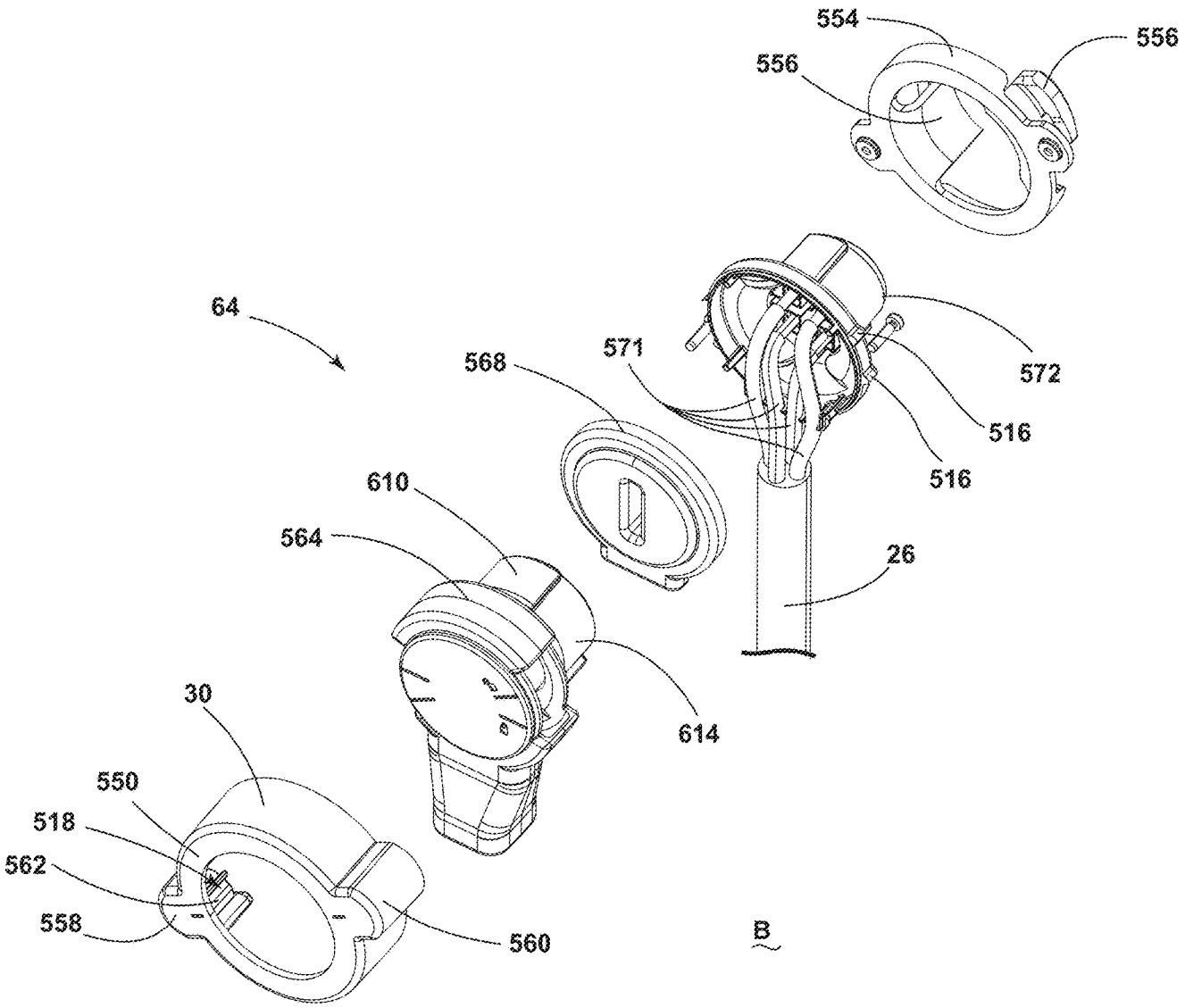
FIG. 22B is an exploded partial top perspective view of the 4-wire power cord assembly of FIG. 21.
Figure 23A:
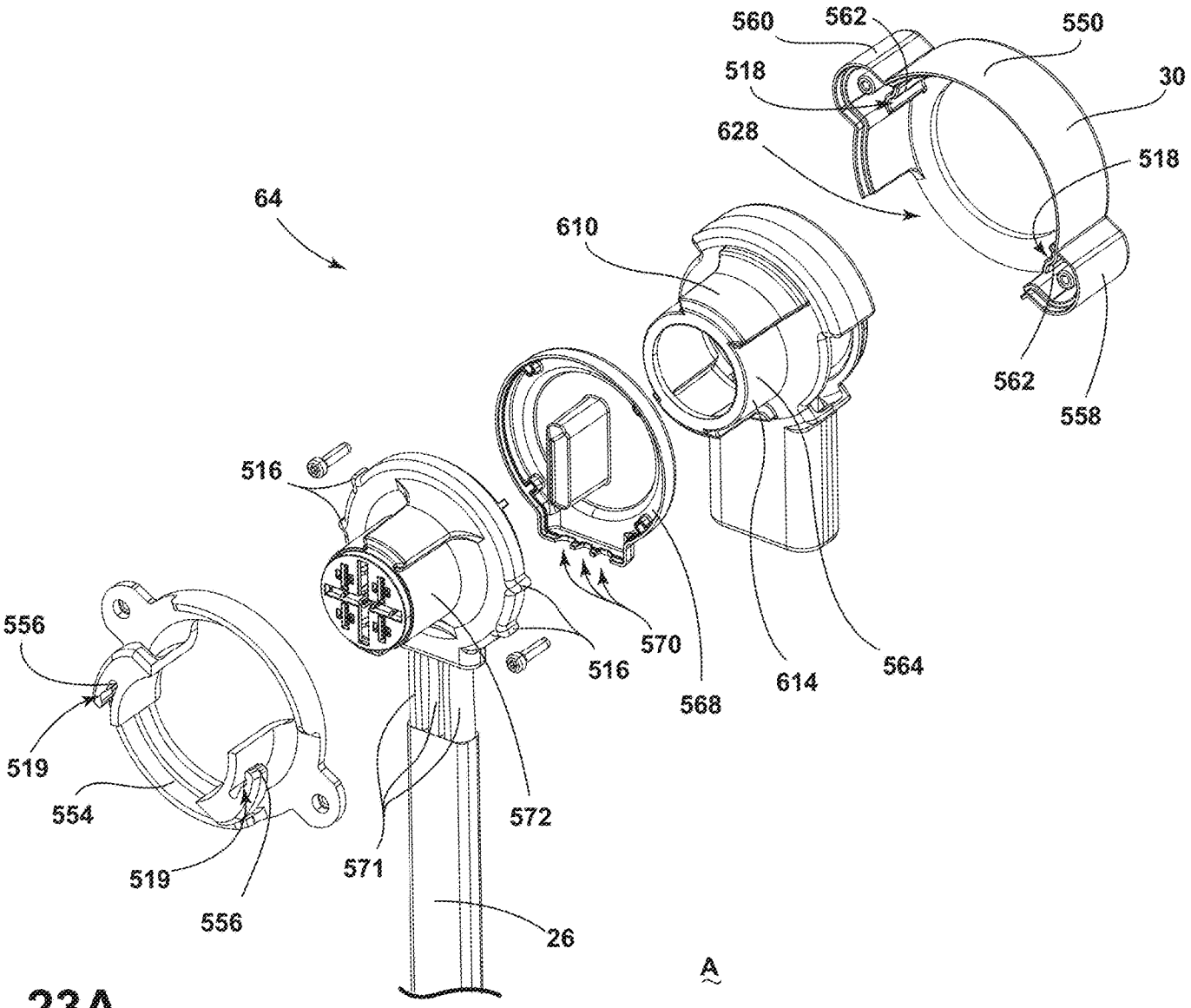
FIG. 23A is an exploded partial rear perspective view of the 3-wire power cord assembly of FIG. 21.
Figure 23B:
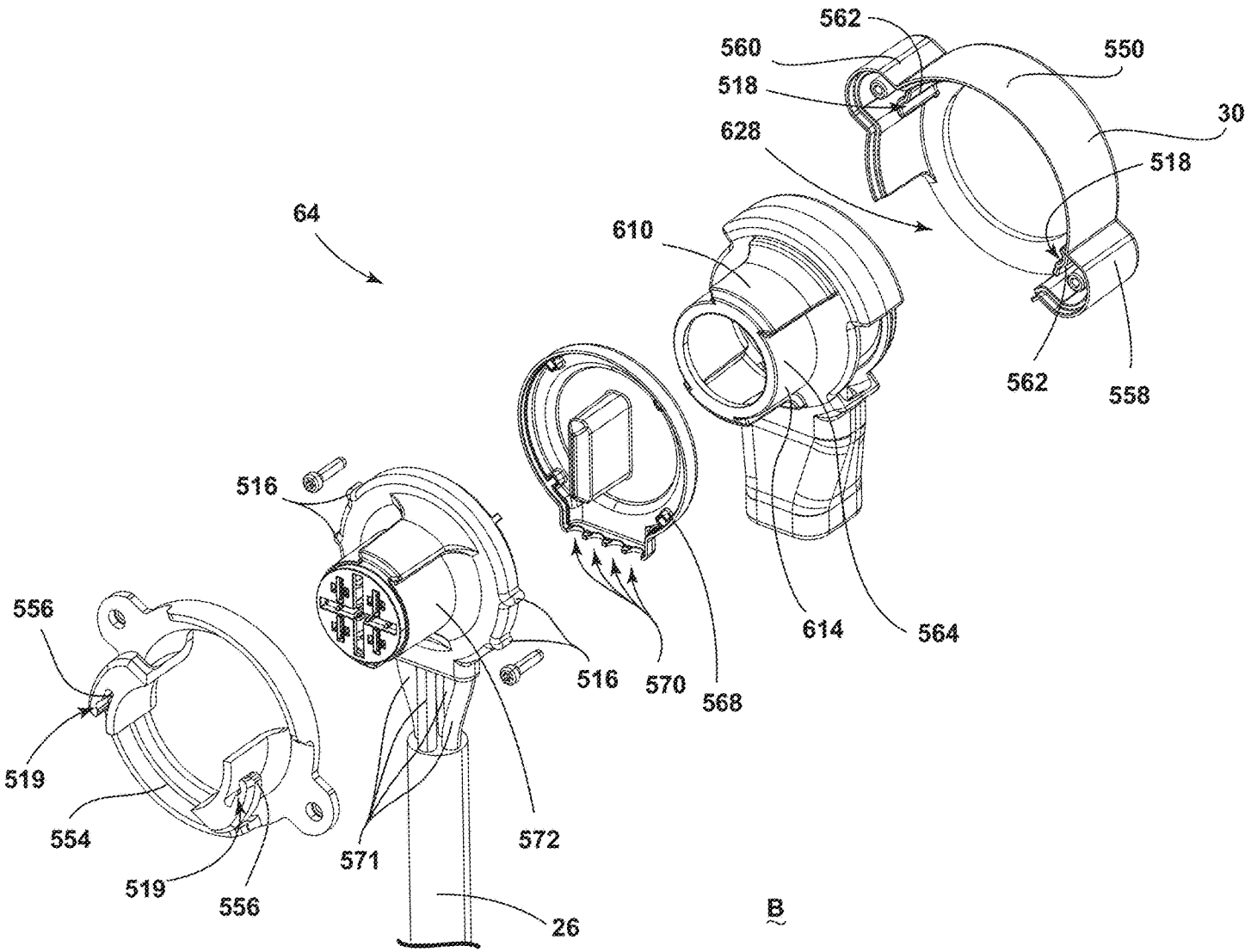
FIG. 23B is an exploded partial rear perspective view of the 4-wire power cord assembly of FIG. 21.

The power cord assembly 64 is exemplarily illustrated having the three-wire configuration A in FIGS. 21, 22A, and 23A and having the four-wire configuration B in FIGS. 21, 22B, and 23B. The power cord assembly 64 includes the cap 30 having first and second portions 550, 554. The first portion 550 of the cap 30 includes lateral protrusions 558, 560. Each of the lateral protrusions 558, 560 may have a generally semi-circular cross-section. In some examples, the lateral protrusions 558, 560 may be configured to facilitate rotation of the cap 30 when the power cord assembly 64 is received by the receptacle assembly 62. In other examples, the lateral protrusions 558, 560 may be configured to house a receiving member 562 that defines the receiving space 518 of the locking assembly 604.

The second portion 554 of the cap 30 includes locking protrusions 556 configured to couple the power cord 26 to the receptacle 18. The locking protrusions 556 are configured to extend circumferentially about the second portion 554 of the cap 30 and are selectively engageable with the receptacle 18 when the power cord assembly 64 is at least partially received by the receptacle 18. In various examples, the locking protrusions 556 may be configured to at least partially maintain the cap 30 in the locked position. For example, the locking protrusions 556 may define the receiving space 518 of the locking assembly 604, as discussed in more detail elsewhere herein.

The power cord 26 of the power cord assembly 64 may be received by the cap 30 or may be integrally formed with the cap 30. As discussed previously, the power cord 26 may have any configuration such as, for example, the three-wire configuration (FIGS. 22A and 23A) or the four-wire configuration (FIGS. 22B and 23B). For any configuration, the power cord 26 includes an overmold 564, an inner housing plate 568, and a front inner housing 572. The overmold 564 includes a first portion 610 and a second portion 614 where the first portion 610 extends outward from the second portion 614. The second portion 614 is positioned to align with the locking protrusions 556 of the cap 30 so that the locking protrusions 556 are substantially flush with the second portion 614 of the overmold 564 when the cap 30 is positioned over the power cord 26.

The front inner housing 572 is configured to be coupled with the inner housing plate 568. The inner housing plate 568 is includes a plurality of cord slots 570 configured to receive wires 571 of the power cord 26. The plurality of cord slots 570 are configured to complement the configuration of the wires 571 (e.g., the three-wire configuration as shown in FIGS. 22A and 23A or the four-wire configuration as shown in FIGS. 22B and 23B). The front inner housing 572 and the inner housing plate 568 are further configured to be at least partially encased by the overmold 564. For example, the front inner housing 572 may be configured to extend into the first portion 610 of the overmold 564 with a front face of the front inner housing 572 exposed through the first portion 610 of the overmold 564. Together, the front inner housing 572 and the first portion 610 of the overmold 564 are at least partially received by the receptacle 18 when the power cord assembly 64 is coupled with the receptacle assembly 62. In various examples, the front inner housing 572 may be configured as a female connector configured to receive a male connector of the receptacle assembly 62. In other examples, the front inner housing 572 may be configured as a male connector and may be configured to be received by female connectors of the receptacle assembly 62. It is contemplated that the power cord 26 may have the same configuration of any other power cord 26 disclosed herein.

Figure 24A:
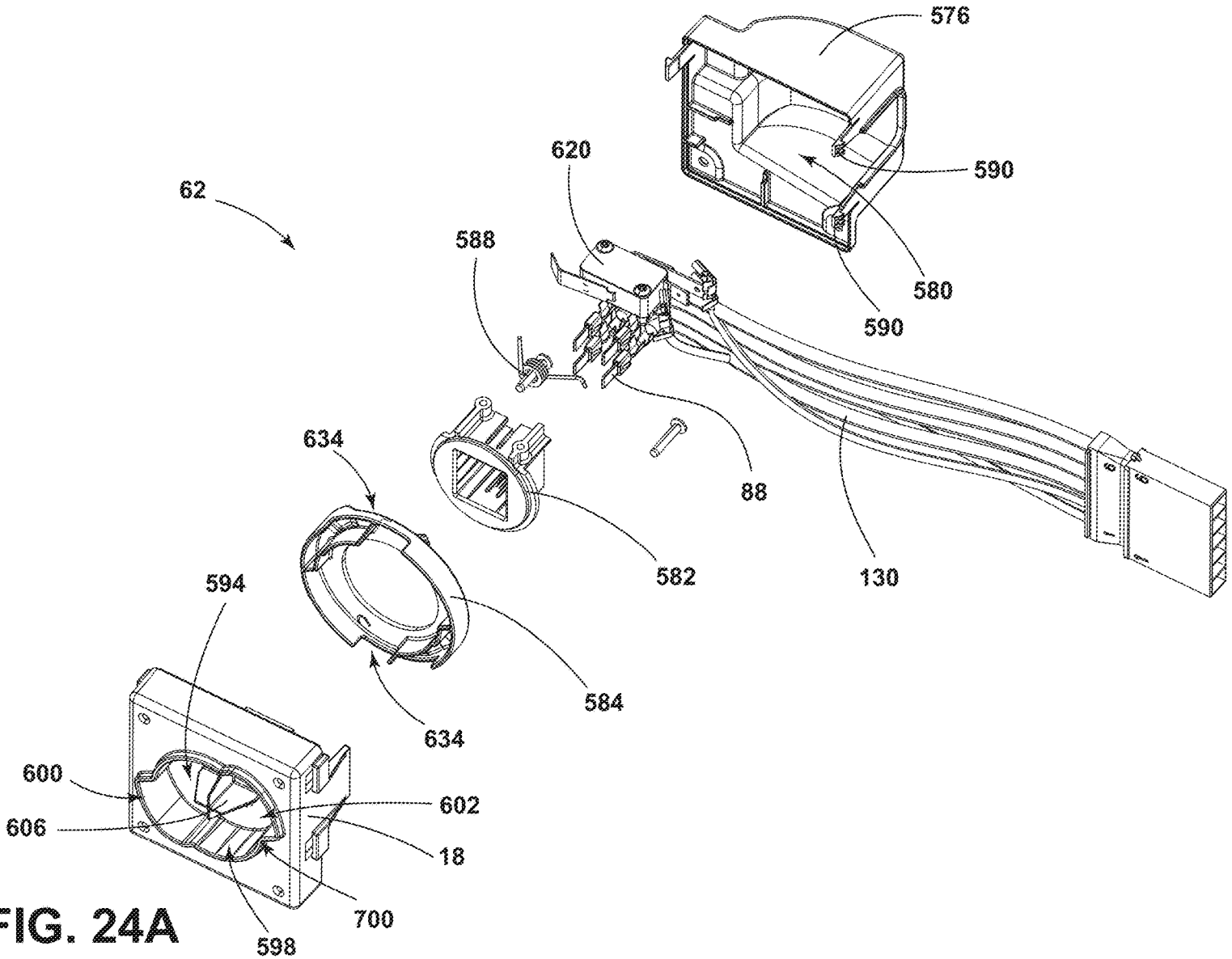
FIG. 24A is an exploded partial top perspective view of the receptacle assembly of FIG. 21.
Figure 24B:
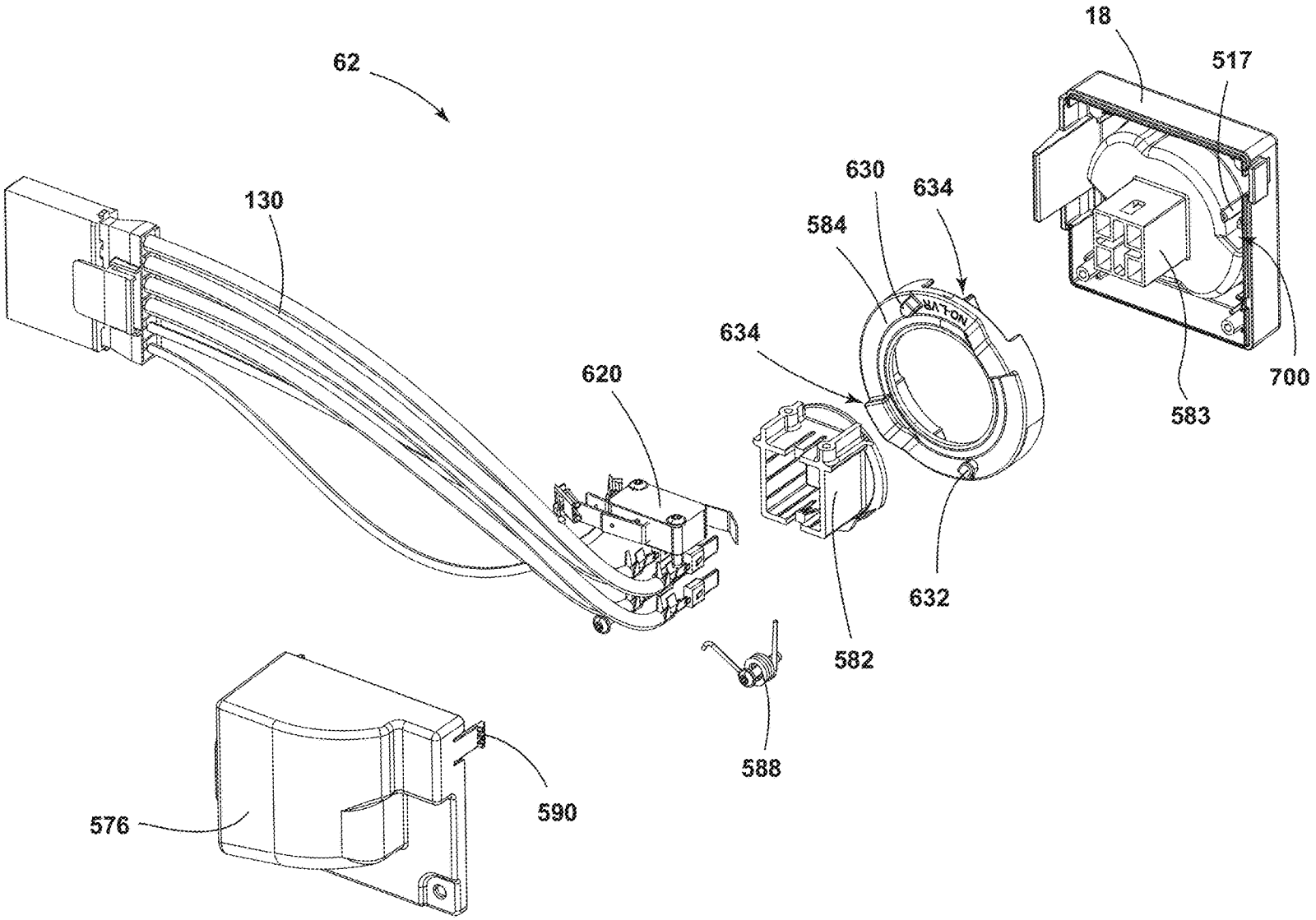
FIG. 24B is an exploded partial rear perspective view of the receptacle assembly of FIG. 21.

Referring now to FIGS. 21, 24A, and 24B, the receptacle assembly 62 includes the receptacle 18 and a housing 576 configured to couple with the receptacle 18. The housing 576 defines a cavity 580 that is configured to receive the plurality of prongs 88 and the corresponding electrical wiring 130. The housing 576 may include a guide 582 configured to house the plurality of prongs 88 within the cavity 580. The guide 582 may be coupled with the receptacle 18 to extend rearward from the receptacle 18 into the housing 576. In various examples, the guide 582 may be coupled with a rear extension 583 of the receptacle 18. In other examples, the plurality of prongs 88 may be positioned within the housing 576 without the guide 582. The housing 576 may be coupled with the receptacle 18 by a plurality of clips 590. It will be understood that the housing 576 and the receptacle 18 may be coupled using other methods, including, for example, fasteners, adhesives, and/or any methods and configurations described previously, without departing from the scope of the present disclosure.

The receptacle 18 defines a receiving well 594 that has a central space 598 and first and second lateral spaces 600, 602 in communication with the central space 598. The plurality of prongs 88 are positioned to extend into the central space 598 through a rear panel of the receptacle 18. The plurality of prongs 88 may be positioned about a fin 606. In various examples, the fin 606 may have an X-shaped cross-section with each of the prongs 88 positioned in a quadrant that defines the fin 606. However, in other examples, the fin 606 may have other cross-sections, including, for example, a T-shaped cross-section, a cross-shaped cross-section, or a rectangular cross-section. The fin 606 is configured to guide, and may partially secure, the power cord 26 into engagement with the receptacle 18.

Referring now to FIGS. 24A and 24B, a ring 584 may be positioned around a perimeter of the guide 582 and proximate the receptacle 18. The ring 584 is movable between a neutral position and a compressed position. In various examples, the guide 582 may extend through an opening defined by the ring 584. The ring 584 may include a first post 630 and a second post 632 that extends from the ring 584. The first post 630 is positioned proximate a switch 620 of the receptacle assembly 62. The switch 620 may be integrally formed with the receptacle assembly 62. The second post 632 is configured to be operably coupled to a spring 588. In various examples, the spring 588 may be a torsion spring 588. The spring 588 may be configured to facilitate rotation of the ring 584 between first and second positions and may be configured to bias the ring 584 into the neutral position.

Referring now to FIGS. 21-24B, the cap 30 includes the first and second portions 550, 554. The first portion 550 defines a slot 628 to allow rotation of the cap 30 around the power cord 26 without obstruction. The second portion 554 includes the protrusions 556 configured to engage with the receptacle 18 and the ring 584. The protrusions 556 are received by the first and second lateral spaces 600, 602. The lateral spaces 600, 602 generally complement the shape of the protrusions 556, and the central space 598 generally complements the shape of the power cord 26. Each of the protrusions 556 may be generally hook-shaped. The protrusions 556 may be configured to engage with the ring 584 to rotate the ring 584 as the cap 30 rotates to lock the power cord 26 into engagement with the receptacle 18. Alternatively, the protrusions 556 may directly engage with the switch 620.

The protrusions 556 of the cap 30 may be configured to be at least partially received by the ring 584 and the receptacle 18. When the protrusions 556 are received by the ring 584 and the receptacle 18, the cap 30 is rotatable between a first position and a second position. When the cap 30 is in the first position, the protrusions 556 are disengaged from the ring 584. When the cap 30 is in the second position, the protrusions 556 extend through spaces 700 defined by the receptacle 18 and are at least partially engaged with the ring 584. The protrusions 556 may be received by channels 634 defined by the ring 584. The rotation of the cap 30 is in an opposite direction of the bias provided by the spring 588. The spring 588 is positioned to engage with the first post 630 extending from the ring 584. The spring 588 provides a force to the second post 632 to rotate the ring 584 out of engagement with the switch 620.

When the cap 30 is in the second position and the protrusions 556 are engaged with the ring 584, the ring 584 is rotated to engage with the switch 620. The switch 620 may be contacted by the first post 630 of the ring 584. The protrusions 556 are received by the channels 634 to rotate the ring 584 opposite the force provided by the spring 588 on the second post 632. The ring 584 is rotated so that the first post 630 is rotated into engagement with the switch 620. When the ring 584 is engaged with the switch 620, the locking assembly 604 may be locked to hold the cap 30 and protrusions 556 in engagement with the ring 584. The locking assembly 604 may be a detent spring 508 and first and second notches 500, 504, as discussed above with regard to FIGS. 20A and 20B, or the locking assembly 604 may include locking extensions 516, 517 configured to engage with receiving spaces 518, 519 (FIGS. 25A-26). The locking assembly 604 further locks the ring 584 into engagement with the switch 620 to provide power to the appliance 14 (FIG. 1). In another aspect of this disclosure, the cap 30 and/or the locking assembly 604 may be used to couple the power cord assembly 64 with the receptacle assembly 62. It is conceived that there may be no switch 620 in this configuration or that the switch 620 may be closed by another method (i.e., a user manually closing the switch 620 by an external lever).

Figure 25B:
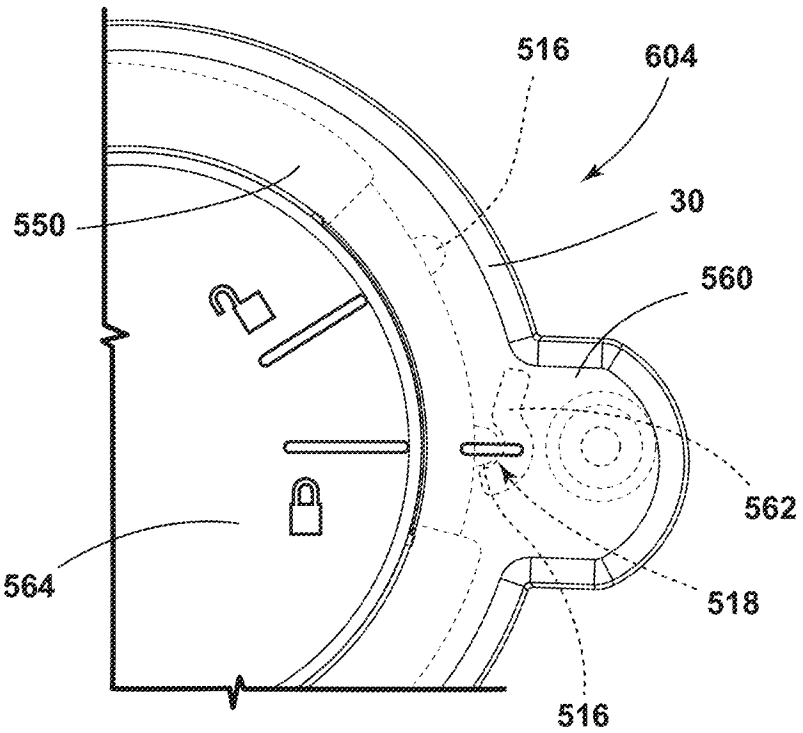
FIG. 25B is a partial front elevational view of the locking assembly of FIG. 25A shown in a second position.
Figure 25A:
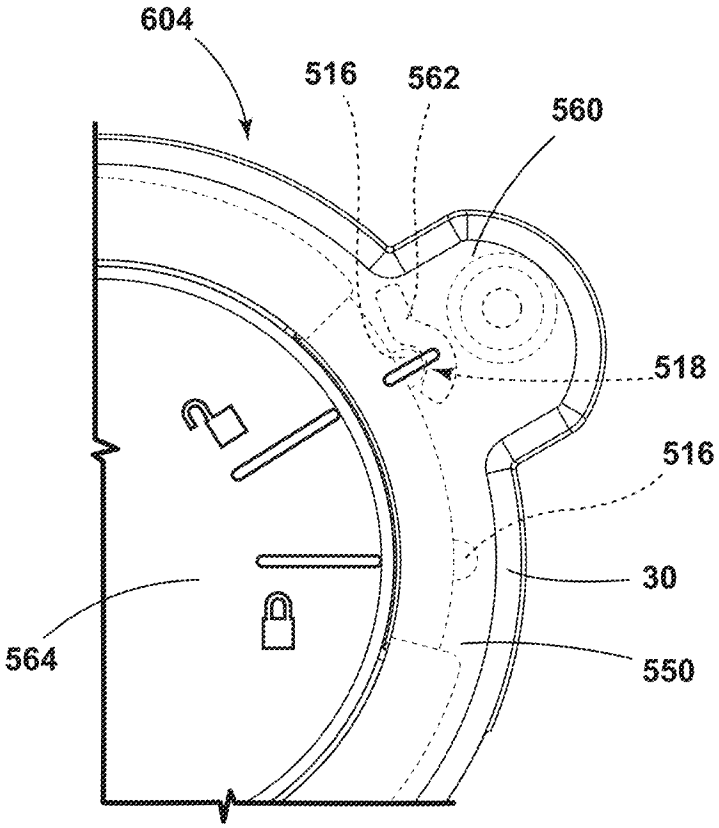
FIG. 25A is a partial front elevational view of a locking assembly shown in a first position, according to various examples.
Figure 26:
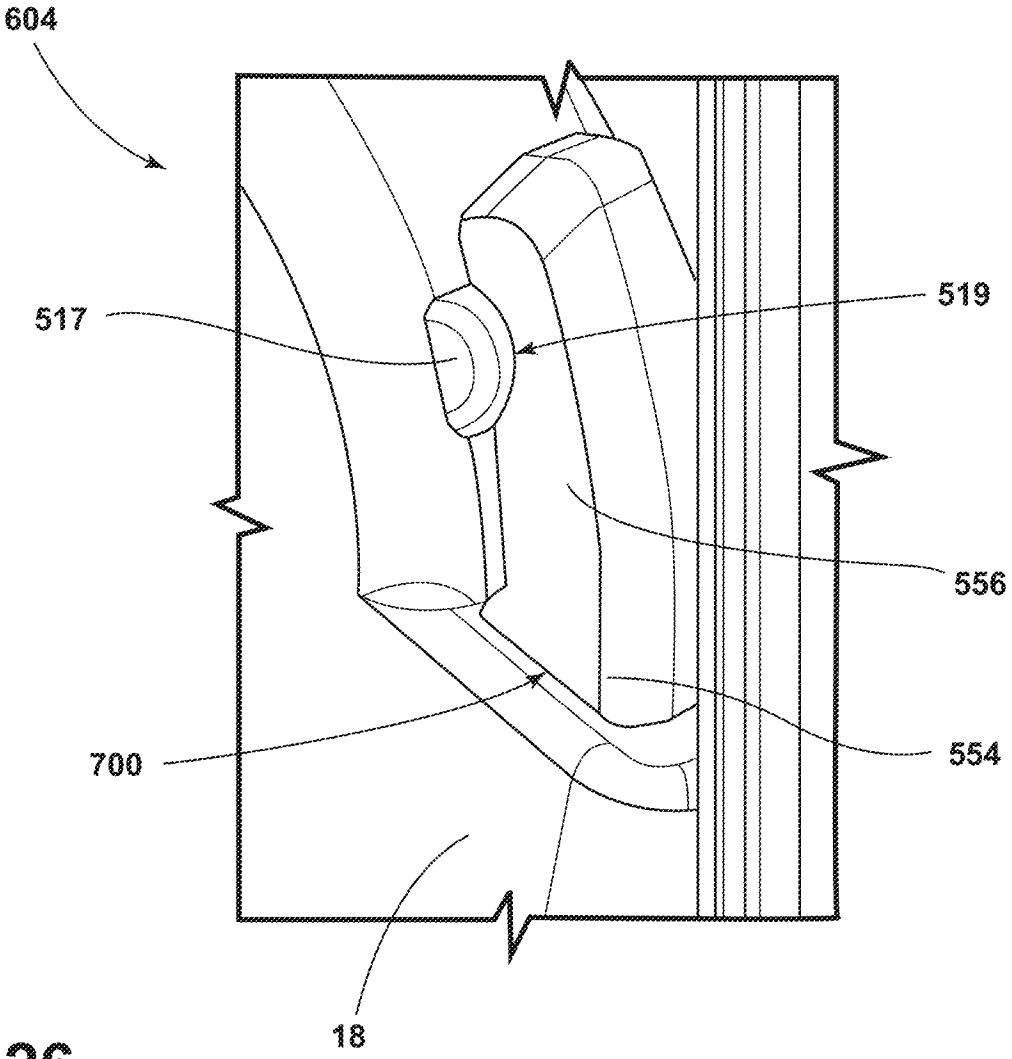
FIG. 26 is a partial rear elevational view of a locking assembly shown in a locked position, according to various examples.

Referring now to FIGS. 22A-25B, the locking assembly 604 may be integrally formed with the power cord assembly 64. For example, the front inner housing 572 may include at least one locking extension 516 configured to engage with one of the receiving spaces 518 of the receiving members 562. The locking extensions 516 extend outward from the front inner housing 572. In some examples, as shown in FIGS. 25A and 25B, the locking extensions 516 may be positioned in pairs and may be selectively received by the respective receiving space 518.

Referring now to FIGS. 22A-24B and FIG. 26, the locking assembly 604 may be integrally formed with both the receptacle assembly 62 and the power cord assembly 64. For example, the receiving spaces 519 may be defined by the protrusions 556 of the cap 30. The receiving spaces 519 may be configured to receive locking extensions 517 positioned on the receptacle 18, as illustrated in FIG. 26. The cap 30 is locked when the locking extensions 517 are received by the receiving spaces 519.

The power connection assembly 10 creates a simple and user-friendly connection between the power cord 26 and the appliance 14. Previously, power cords 26 were wired directly with the appliance 14 based on instructions provided to the consumer and were not readily interchangeable. The cap 30, as disclosed herein, may be used with 3-wire power cords and/or 4-wire power cords and provides an easier connection than previous wiring requirements. The cap 30 utilizes a plug and play connection approach with the switch 42, 620 to ensure a proper connection between the power cord 26 and the appliance 14. This results in an easy, streamlined installation for the consumer to create a safe and effective transfer of electrical power to the appliance 14.

According to one aspect, a power connection assembly for an appliance may include a receptacle positioned on a mounting plate. A switch may be positioned proximate the receptacle and may be operable between an open position and a closed position. A cap may have an outer portion and an inner portion. The outer portion may be operably coupled with the inner portion to secure the cap on a power cord received by the receptacle. The power connection assembly may further include a protrusion that extends from the inner portion of the cap. The protrusion and the inner portion of the cap may define a first slot. The power connection assembly may further include a ring positioned to fit around the receptacle and may include a spring disposed within a second slot. The second slot may be defined by an inner wall of the receptacle and the ring.

According to still other aspects, an inner wall of a receptacle may be configured to be received by a first slot. A protrusion of a cap may be configured to be received by a second slot when the cap is in a locked position.

According to other aspects, a locking assembly may be positioned within an outer portion of a cap to maintain the cap in a locked position.

According to other aspects, a ring may be rotatable between a neutral position and a compressed position. The neutral position may be related to an unlocked position of a cap. The compressed position may be related to a locked position of the cap.

According to another aspect, a ring may include a projection positioned to engage with a switch when the ring is rotated into a compressed position. The projection may move the switch to a closed position.

According to still another aspect, a power cord may define a plurality of spaces configured to receive a plurality of prongs that extend from a receptacle.

According to other aspects, a mounting plate may define a first opening configured to receive a power cord. The power cord may operate at a voltage of one of 110 volts, 120 volts, 220 volts, and 240 volts.

According to still other aspects, a receptacle may define a cavity that has a first opening and a second opening. The first opening may be aligned with the second opening.

According to another aspect, a receptacle may define a channel configured to receive a protrusion.

According to other aspects, a power connection assembly may be provided that includes a receptacle that has an inner wall. A channel may be defined by the inner wall. A power cord may be received by the receptacle. A cap may be rotatable between a locked position and an unlocked position. The cap may be configured to at least partially encase the power cord. The cap may include a protrusion extending perpendicular to a body of the cap. The power connection assembly may further include a switch positioned proximate the channel and operable between an open position and a closed position. The protrusion may be received by the channel and may be configured to move the switch to a closed position.

According to another aspect, a channel may include a first portion, a second portion, and a third portion. A cap may be in a locked position when a protrusion is received by a third portion of a channel.

According to other aspects, a spring may be positioned within a cap and may be configured to bias the cap in an unlocked position.

According to another aspect, a power connection assembly includes a receptacle positioned on a mounting plate, a power cord received by the receptacle, and a cap positioned over the power cord. The cap may be operable between a locked position and an unlocked position. The power connection assembly may further comprise a protrusion that extends from the cap and is received by the receptacle, a spring configured to bias the cap in the unlocked position, and a switch positioned proximate the receptacle and configured to be actuated when the cap is in the locked position.

According to other aspects, a spring may be positioned within a ring. The ring may be engaged with a protrusion when a cap is in a locked position.

According to still other aspects, a cap may include a detent spring configured to lock the cap in a locked position.

According to still other aspects, a protrusion may be configured to engage with a pin when a cap is in a locked position. The pin may be configured to actuate a switch.

According to another aspect, a power connection assembly includes a housing positioned over a power cord. The housing may surround a locking assembly. The locking assembly may be operable between an unlocked and a locked position. A protrusion may extend from the housing and may be rotatable between a first portion and a second position. The first and second positions may correspond with the unlocked and locked positions of the locking assembly, respectively. A spring may be configured to bias the protrusion in the first position. A switch may be positioned proximate the receptacle and may be configured to be actuated when the locking assembly is in the locked position.

According to other aspects, a housing may include a cap that has a first portion and a second portion. The first portion may partially encompass a power cord. The second portion may include a protrusion.

According to still other aspects, a locking assembly may be a detent spring selectively engageable with one of a first notch and a second notch. The first and second notches may be defined by a power cord.

According to other aspects, a spring may be a torsion spring positioned proximate a ring. The ring may include a post selectively engageable with the spring.

According to still other aspects, a ring may be engaged with a protrusion when a locking assembly is in a locked position.

According to another aspect, a power connection assembly for an appliance may include a receptacle that has an inner wall. The inner wall may define a cavity. A channel may be defined by the inner wall and may be in communication with the cavity. A power cord may be configured to be at least partially received by the cavity of the receptacle. A cap may be rotatable between a locked position and an unlocked position and may be configured to at least partially encase the power cord. A protrusion may extend radially from the cap. A switch may be positioned proximate the channel and may be operable between an open position and a closed position. The protrusion may be received by the channel and may be configured to move the switch to a closed position.

According to another aspect, a switch may be integrally formed with a receptacle.

According to another aspect, a power connection assembly may include a channel defined by an inner wall of a receptacle. The channel may include a first portion, a second portion, and a third portion. The second portion may be perpendicular to the first portion and the third portion. A cap may be in a locked position when a protrusion is received by a third portion.

According to another aspect, a spring may be positioned within the cap. The spring may be configured to bias the cap away from a receptacle.

According to another aspect, a protrusion may be configured to engage with a member when a cap is in a locked position. The member may be pivotally coupled with a receptacle and may be configured to actuate a switch when the cap is in the locked position.

According to another aspect, a power cord may include a tab configured to engage with a notch defined by a receptacle. The tab and the notch may form a poka-yoke keyway.

According to another aspect, a power connection assembly for an appliance may include a receptacle coupled with a mounting plate. A power cord may be configured to be received by the receptacle. A cap may be coupled with the power cord and may be configured to be at least partially received by the receptacle. A protrusion may extend from the cap. The protrusion may define a first slot. A ring may be rotatably coupled with the receptacle and may define a second slot. The second slot may be defined by an inner wall of the receptacle and the ring. A spring may be received by the second slot and may be configured to bias the ring in a neutral position.

According to another aspect, a cap may be rotatable between a locked position and an unlocked position. The unlocked position of the cap may be related to a neutral position of a ring. The locked position of the cap may be related to a compressed position of the ring. The cap may include a locking assembly to maintain the cap in the locked position.

According to another aspect, a ring may include a stop that extends radially inward and proximate a spring. A protrusion may be configured to abut the ring when a cap is in an unlocked position.

According to another aspect, an inner wall of the receptacle may include a first portion and a second portion. The second portion may have an end proximate the second slot. A spring may be configured to be compressed between an end and a stop when a ring is in a compressed position.

According to another aspect, a power connection assembly may include a housing positioned over a power cord. The housing may surround a locking assembly. The locking assembly may be operable between an unlocked and a locked position. A protrusion may extend from the housing and may be rotatable between a first portion and a second position. The first and second positions may correspond with the unlocked and locked positions of the locking assembly, respectively. A spring may be configured to bias the protrusion in the first position. A switch may be configured to be actuated when the locking assembly is in the locked position.

According to another aspect, a power connection assembly may include a receptacle defining a cavity. A ring may be operably coupled with the receptacle. The ring may include a pin configured to be engaged with a spring. The ring may be configured to be rotated by rotation of a locking assembly.

According to another aspect, a locking assembly may include a receiving space configured to engage with a locking extension.

According to another aspect, a power connection assembly for an appliance may include a cap operably coupled with a power cord. The cap may be rotatable between a locked position and an unlocked position and may be configured to at least partially encase the power cord. A receptacle may be configured to at least partially receive the power cord. A protrusion may extend from the cap. A spring may be configured to bias the cap into the unlocked position. A switch may be operable between an open position and a closed position. The switch may be in the closed position when the cap is in the locked position.

According to another aspect, a power connection assembly for an appliance may include a ring rotatably coupled with a receptacle. A protrusion may define a first slot. The ring may define a second slot. The spring may be received by the second slot and may be configured to bias the ring in a neutral position.

According to another aspect, a cap may include a locking assembly configured to maintain the cap in a locked position.

According to another aspect, a power connection assembly may include a ring. The ring may be rotatably coupled with a receptacle. A protrusion of a cap may define a first slot. The ring may define a second slot. A spring may be received by the second slot and may be configured to bias the ring in a neutral position.

According to another aspect, a power connection assembly may include a ring. The ring may be configured to be rotated in conjunction with a cap and may include a first post and a second post. The second post may be operably coupled with a spring to bias the ring in a neutral position.

According to another aspect, a first post may extend parallel with a second post and may be configured to engage a switch when a ring is rotated into a compressed position and a cap is in a locked position.

According to another aspect, a locking assembly may include a detent spring selectively engageable with a locking notch.

According to another aspect, a locking assembly may include a locking extension configured to be received by a receiving space of a cap.

According to another aspect, a receiving space may be defined by a cap.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the portion or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

What is claimed is:

1. A power connection assembly for an appliance, comprising:

a receptacle having an inner wall, the inner wall defining a cavity;

a channel defined by the inner wall and in communication with the cavity;

a power cord configured to be at least partially received by the cavity of the receptacle;

a cap rotatable between a locked position and an unlocked position and configured to at least partially encase the power cord;

a protrusion extending radially from the cap; and a switch positioned proximate the channel and operable between an open position and a closed position, wherein the protrusion is received by the channel and is configured to move the switch to the closed position.

2. The power connection assembly of claim 1, wherein the switch is integrally formed with the receptacle.

3. The power connection assembly of claim 1, wherein the channel includes a first portion, a second portion, and a third portion, and wherein the second portion is perpendicular to the first portion and the third portion, and further wherein the cap is in the locked position when the protrusion is received by the third portion.

4. The power connection assembly of claim 1, wherein a spring is positioned within the cap, and further wherein the spring is configured to bias the cap away from the receptacle.

5. The power connection assembly of claim 1, wherein the cap includes a detent spring configured to lock the cap in the locked position.

6. The power connection assembly of claim 1, wherein the protrusion is configured to engage with a member when the cap is in the locked position, and further wherein the member is pivotally coupled with the receptacle and is configured to actuate the switch when the cap is in the locked position.

7. The power connection assembly of claim 1, wherein the power cord includes a tab configured to engage with a notch defined by the receptacle, and further wherein the tab and the notch form a poka-yoke keyway.

8. A power connection assembly for an appliance, comprising:

a receptacle coupled with a mounting plate;

a power cord configured to be received by the receptacle;

a cap coupled with the power cord and configured to be at least partially received by the receptacle;

a protrusion extending from the cap, wherein the protrusion defines a first slot;

a ring rotatably coupled with the receptacle, wherein a second slot is defined by an inner wall of the receptacle and the ring; and a spring received by the second slot and configured to bias the ring in a neutral position.

9. The power connection assembly of claim 8, wherein the cap is rotatable between a locked position and an unlocked position, and wherein the unlocked position of the cap is related to the neutral position of the ring and the locked position of the cap is related to a compressed position of the ring, and further wherein the cap includes a locking assembly to maintain the cap in the locked position.

10. The power connection assembly of claim 9, wherein the locking assembly is a detent spring selectively engageable with a notch.

11. The power connection assembly of claim 9, wherein the ring includes a stop extending radially inward and proximate the spring, and further wherein the protrusion is configured to abut the ring when the cap is in the unlocked position.

12. The power connection assembly of claim 11, wherein the inner wall of the receptacle includes a first portion and a second portion, the second portion having an end proximate the second slot, and further wherein the spring is configured to be compressed between the end and the stop when the ring is in the compressed position.

13. The power connection assembly of claim 9, further comprising:

a switch positioned proximate the receptacle, wherein the ring includes a projection positioned to engage with the switch when the ring is rotated into the compressed position, and further wherein the projection moves the switch to a closed position.

14. The power connection assembly of claim 8, wherein the mounting plate defines a first opening configured to receive the power cord, and further wherein the power cord operates at a voltage of one of 110 volts, 120 volts, 220 volts, and 240 volts.

15. A power connection assembly comprising:

a housing positioned over a power cord, wherein the housing surrounds a locking assembly, the locking assembly operable between an unlocked and a locked position;

a protrusion extending from the housing and rotatable between a first position and a second position, the first and second positions corresponding with the unlocked and locked positions of the locking assembly, respectively;

a spring configured to bias the protrusion in the first position; and a switch configured to be actuated when the locking assembly is in the locked position.

16. The power connection assembly of claim 15, further comprising:

a receptacle defining a cavity; and a ring operably coupled with the receptacle, the ring including a pin configured to be engaged with the spring, wherein the ring is configured to be rotated by a rotation of the locking assembly.

17. The power connection assembly of claim 16, wherein the switch is integrally formed with the receptacle.

18. The power connection assembly of claim 15, wherein the power cord operates at a voltage of one of 110 volts, 220 volts, and 240 volts.

19. The power connection assembly of claim 15, wherein the locking assembly includes a receiving space configured to engage with a locking extension.

20. The power connection assembly of claim 15, wherein the locking assembly is a detent spring selectively engageable with one of a first notch and a second notch, the first and second notches defined by the power cord.

* * * * *